US011018449B2

(12) United States Patent
Ito

(10) Patent No.: US 11,018,449 B2
(45) Date of Patent: May 25, 2021

(54) CONNECTOR

(71) Applicant: Panasonic Intellectual Property Management Co., Ltd., Osaka (JP)

(72) Inventor: Chikara Ito, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/691,189

(22) Filed: Nov. 21, 2019

(65) Prior Publication Data

US 2020/0169037 A1 May 28, 2020

(30) Foreign Application Priority Data

Nov. 26, 2018 (JP) ..... JP2018-220463

(51) Int. Cl.
*H01R 13/627* (2006.01)
*H01R 12/57* (2011.01)
*H01R 12/71* (2011.01)

(52) U.S. Cl.
CPC ..... *H01R 13/6275* (2013.01); *H01R 12/57* (2013.01); *H01R 12/714* (2013.01)

(58) Field of Classification Search
CPC ..... H01R 13/6272; H01R 13/6275; H01R 12/57; H01R 12/714
See application file for complete search history.

(56) References Cited

U.S. PATENT DOCUMENTS 4,697,862 A * 10/1987 Hasircoglu ..... H01R 12/675 439/394
5,234,356 A * 8/1993 Maejima ..... H01R 13/6272 439/352
5,800,208 A * 9/1998 Ishizuka ..... H01R 13/743 439/557
7,044,773 B2 * 5/2006 Suzuki ..... H01R 12/592 439/260
7,275,948 B2 * 10/2007 Miura ..... H01R 12/79 439/260
7,946,872 B2 * 5/2011 Taketomi ..... H01R 12/79 439/260
9,472,863 B2 * 10/2016 Ozaki ..... H01R 12/772
10,355,385 B1 * 7/2019 Bulmer ..... H01R 12/88
2007/0054540 A1 * 3/2007 Takeda ..... H01R 12/592 439/404
2016/0134034 A1 * 5/2016 Neu ..... H01R 13/6335 439/152
2017/0250501 A1 8/2017 Endo et al.
2017/0256868 A1 * 9/2017 Mathews ..... H01R 12/79

FOREIGN PATENT DOCUMENTS

JP 2017-152273 A 8/2017

* cited by examiner

*Primary Examiner* — Briggitte R. Hammond
(74) *Attorney, Agent, or Firm* — Westerman, Hattori, Daniels & Adrian, LLP

(57) ABSTRACT

A connector includes a housing and a terminal held by the housing and having a mounting part adapted to be mounted on a connecting member. The housing has a recess part in which a for-connection portion of the connecting member is housed and held and a protrusion protruding higher than the thickness of the for-connection portion and defining the recess part. The protrusion is located only at a peripheral edge portion of the housing.

9 Claims, 29 Drawing Sheets

(f)
13
130
130a
131
132
133
134
135
135a
136
136a
137
137a
138
138a
138b
138(130a)
139
139a 14
140
140a
141
142
143
144
145
145a
146
146a
147
147a
148
148a
148b
148(140a)
149
149a

CONNECTOR

CROSS REFERENCE TO RELATED APPLICATIONS

This application is based upon and claims the benefit of priority from prior Japanese Patent Application No. 2018-220463 filed on Nov. 26, 2018: the entire contents of which are incorporated by reference herein.

BACKGROUND OF THE INVENTION

The present disclosure relates to a connector.

Conventionally, there have been known connectors including a housing and terminals that are held in the housing and to be mounted on a connecting member such as a cable, as described in Japanese Patent Application Publication No. 2017-152273 (hereinafter, referred to as patent document 1).

A connector in this patent document 1 has a recess part formed on one side of the housing for housing the connection region (the for-connection portion) of a connecting member. This recess part is defined by protrusions formed by parts on one side of the housing protruding downward. In patent document 1, the protrusions have an approximately T shape in plan view and the thickness of the protrusions is larger than that of the for-connection portion of the connecting member.

SUMMARY OF THE INVENTION

Although it is possible, as for such connectors, to increase the freedom in the connection of the connecting member to the housing, such as the freedom in the shape of the for-connection portion and the freedom in the connecting position of the for-connection portion within the housing, it is preferable to further increase the freedom in the connection of the connecting member to the housing.

Hence, an object of the present disclosure is to provide a connector having a higher freedom in the connection of a connecting member to the housing.

A connector according to the present disclosure includes a housing and a terminal held by the housing and having a mounting part adapted to be mounted on a connecting member. The housing has a recess part in which a for-connection portion of the connecting member is housed and held and a protrusion protruding higher than the thickness of the for-connection portion and defining the recess part. The protrusion is located only at a peripheral edge portion of the housing.

The present disclosure provides a connector having a higher freedom in the connection of a connecting member to the housing.

BRIEF DESCRIPTION OF THE DRAWINGS

FIG. 141B is a back view, FIG. 141C is a side view, and FIG. 141D is a sectional side view, showing the plug housing included in the plug connector.

FIG. 29A is a front view of the plug connector, and FIG. 29B is a diagram for explaining a method of checking the amount of protrusion of the mounting parts of the plug connector.

FIG. 30A is a front view of the plug connector, and FIG. 30B is a diagram for explaining a method of checking the amount of protrusion of the mounting parts of the plug connector.

DESCRIPTION OF THE EMBODIMENTS

With reference to the drawings, an embodiment of the present disclosure is described in detail below. The following description is given of a plug connector 1 mounted on a cable (mounting member) 1A as a connector.

Note that, as for the plug connector 1 and the receptacle connector 2, description is given assuming that a direction perpendicular to (normal to) a mounting surface of a mounting member in a state where each of the connectors is mounted on the mounting member is a top-bottom direction (Z direction). Also, description is given assuming that a direction in which terminals housed in a housing of each connector are arranged is a width direction (Y direction) and a direction in which the terminals are inserted into the housing of each connector is a front-rear direction (X direction).

Furthermore, the top side in a state where the connector mounted on the mounting member is located on the upper side of the mounting surface is defined as the top of the top-bottom direction, while the side on which the connectors face each other when fitted together is defined as the front of the front-rear direction.

Configuration Example of Connector Set

Figure 1:
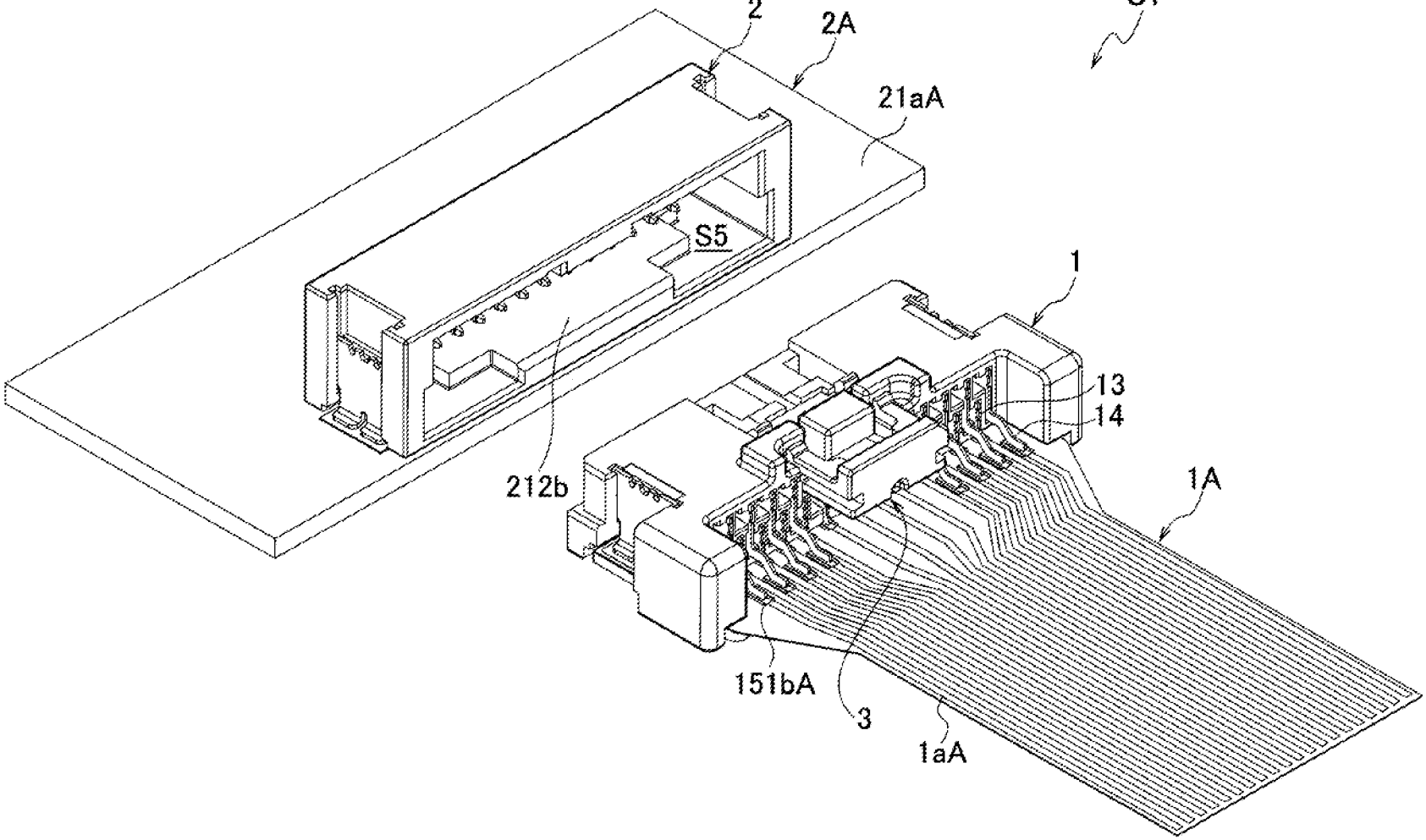
FIG. 1 is an exploded perspective view showing an example of a connector set including a plug connector mounted on a cable and temporarily holding a slide member and a receptacle connector mounted on a circuit board.
Figure 2:
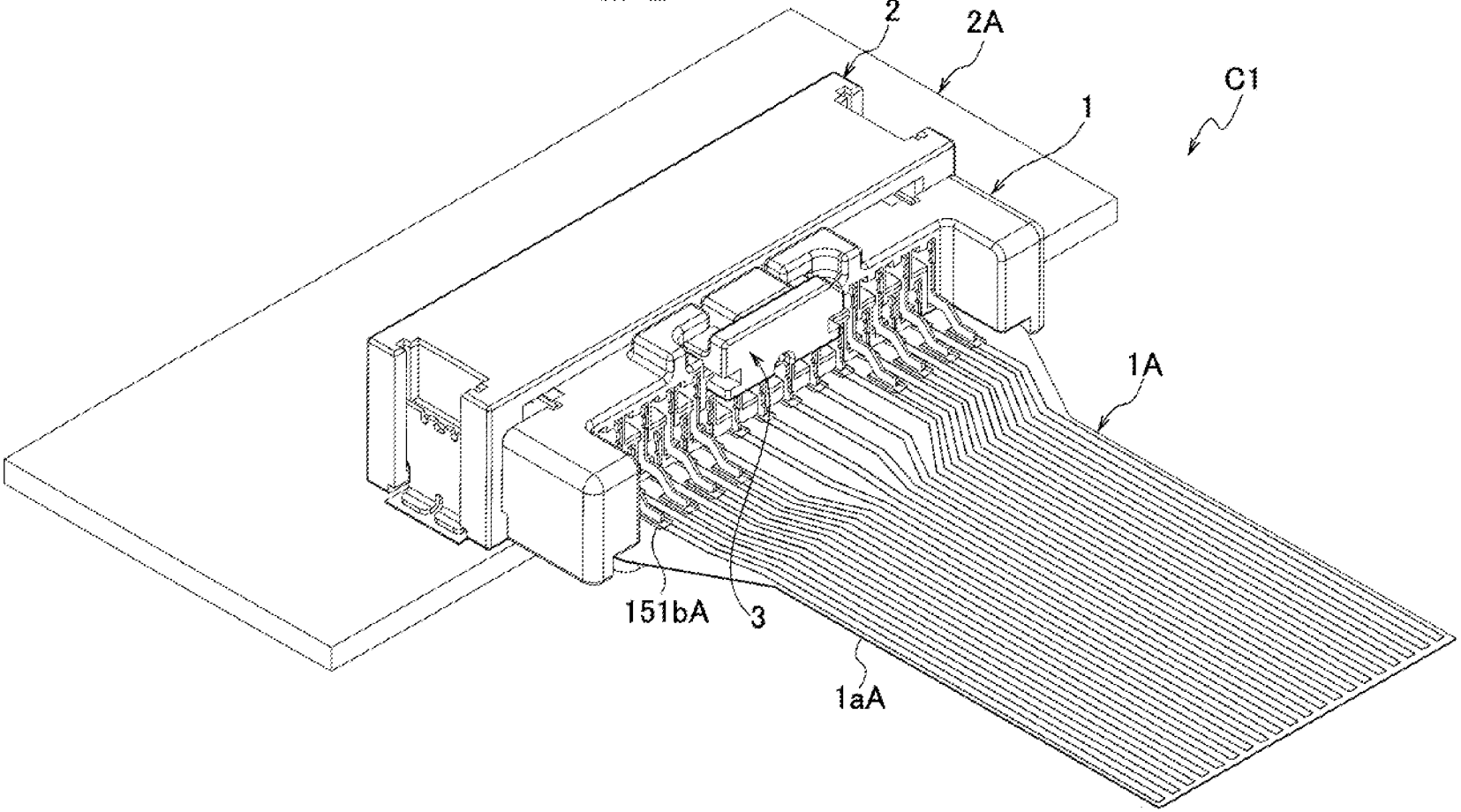
FIG. 2 is a perspective view showing an example of the connector set in a state where the plug connector mounted on the cable and the receptacle connector mounted on the circuit board are fitted together and locked with the slide member.

The plug connector (connector) 1 according to this embodiment is used for a connector set C1 shown in FIGS. 1 and 2 and the like.

The connector set C1 includes a plug connector 1 described above and a receptacle connector (second connector) 2 to which the plug connector 1 is fitted, as shown in FIGS. 1 and 2.

In this embodiment, the plug connector 1 is formed to be mountable on the cable (mounting member: connecting member) 1A such as an FPC and an FFC. More specifically, the plug connector 1 is configured to be mounted on the cable 1A by electrically connecting (mounting) first and second mounting pieces (mounting parts) 132 and 142 of plug terminals (terminals) 13 and 14 included in the plug connector 1 to a conductor part 151*b*A of the cable 1A.

Meanwhile, the receptacle connector 2 is formed to be mountable on the circuit board (opponent mounting member) 2A. More specifically, the receptacle connector 2 is configured to be mounted on the circuit board 2A by electrically connecting (mounting) first and second mounting pieces (opponent mounting parts) 232 and 242 of receptacle terminals (opponent terminals) 23 and 24 included in the receptacle connector 2 to a conductor part 2*b*A of the circuit board 2A.

In the state where the plug connector 1 in which the plug terminals 13 and 14 are held by a plug housing 10, and in which the first and second mounting pieces 132 and 142 are mounted on the cable 1A is fitted into the receptacle connector (opponent connector) 2, the plug terminals 13 and 14 are electrically connected to the receptacle terminal (opponent terminals) 23 and 24 included in the receptacle connector 2.

Figure 3A:
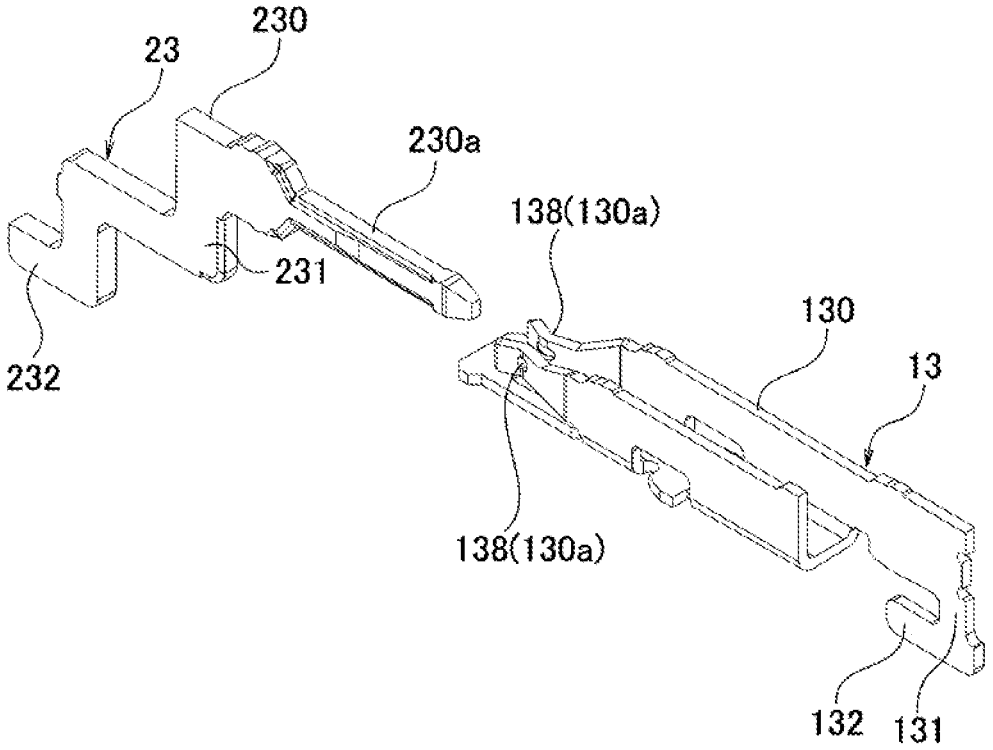
FIG. 3A is a perspective view and FIG. 3B is a plan view showing a lower plug terminal and a lower receptacle terminal included in the connector set shown as an example, FIG. 3A showing a state where the lower plug terminal and the lower receptacle terminal are not in contact with each other and FIG. 3B showing a state where the lower plug terminal and the lower receptacle terminal are in contact with each other.
Figure 3B:
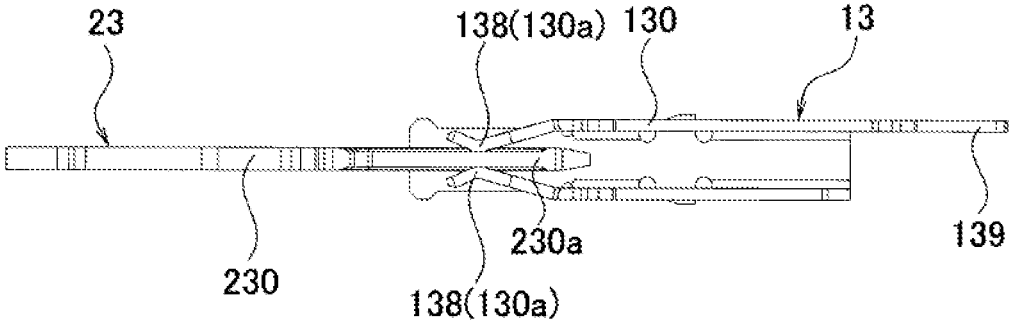
Figure 4A:
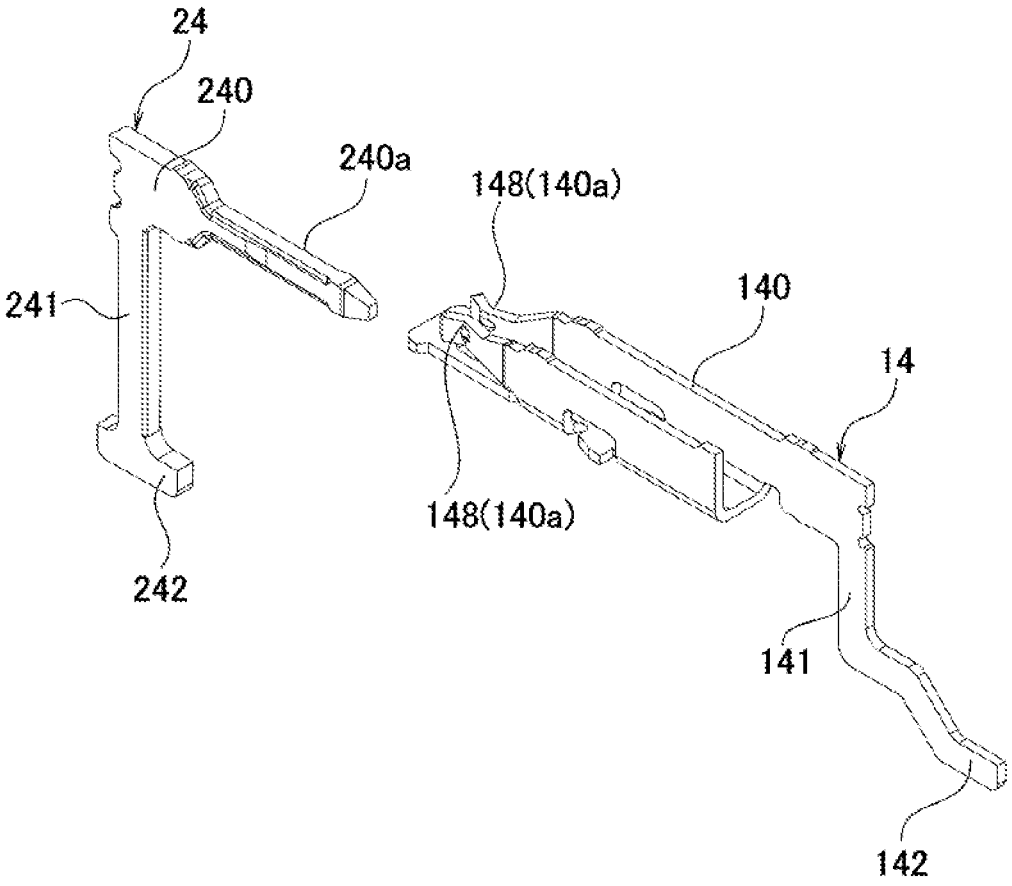
FIG. 4A is a perspective view and FIG. 4B is a plan view showing an upper plug terminal and an upper receptacle terminal included in the connector set shown as an example, FIG. 4A showing a state where the upper plug terminal and the upper receptacle terminal are not in contact with each other and FIG. 4B showing a state where the upper plug terminal and the upper receptacle terminal are in contact with each other.

Thus, the connector set C1 electrically connects the cable 1A to the circuit board 2A by fitting the plug connector 1 into the receptacle connector 2 to achieve conduction between the plug terminals 13 and 14 and the receptacle terminals 23 and 24 (see FIGS. 2 to 4).

Figure 5:
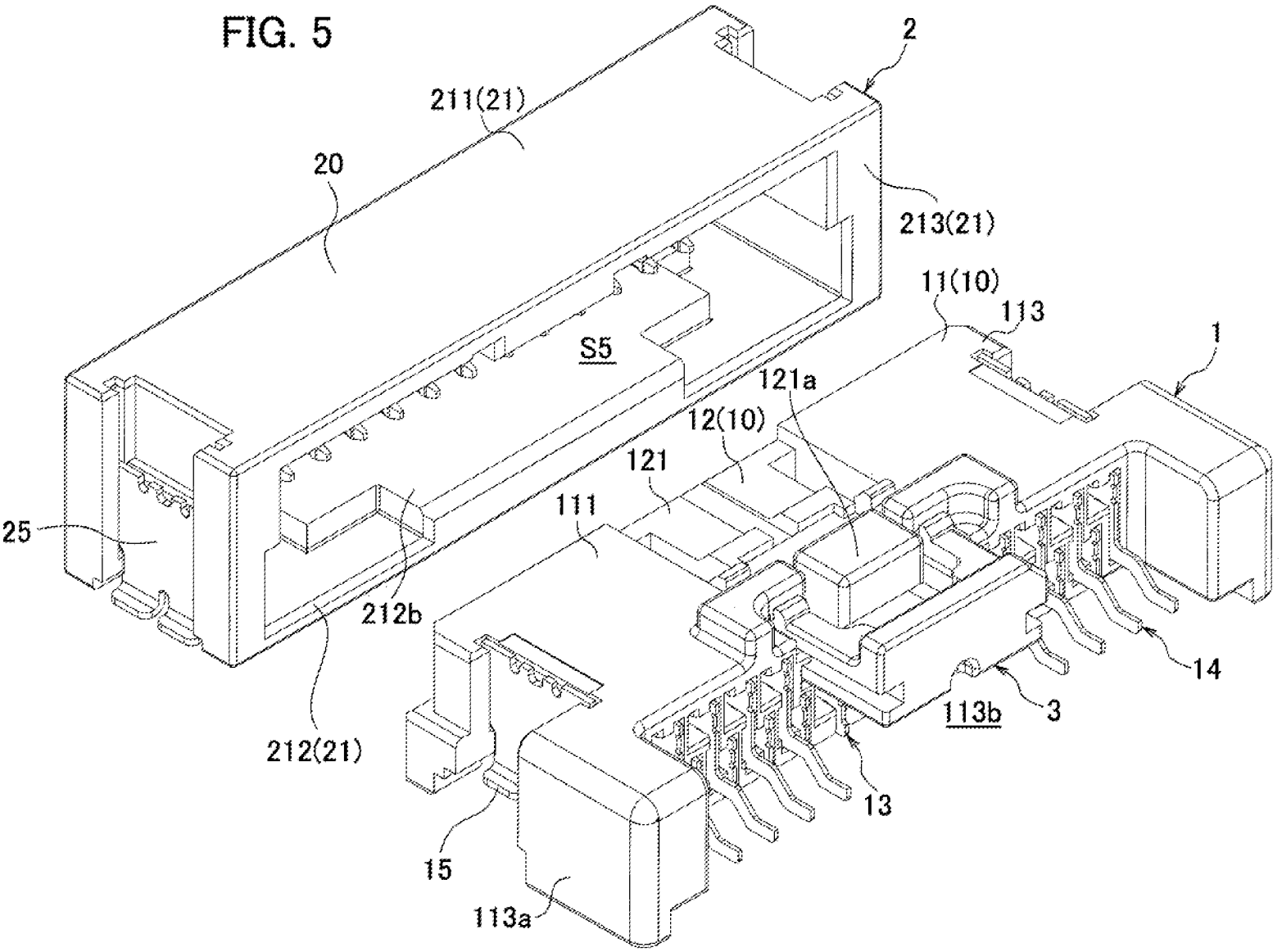
FIG. 5 is a perspective view explaining how the plug connector and the receptacle connector shown as an example are locked with the slide member and showing a state before the plug connector in which the slide member has been temporarily held is fitted to the receptacle connector.
Figure 6:
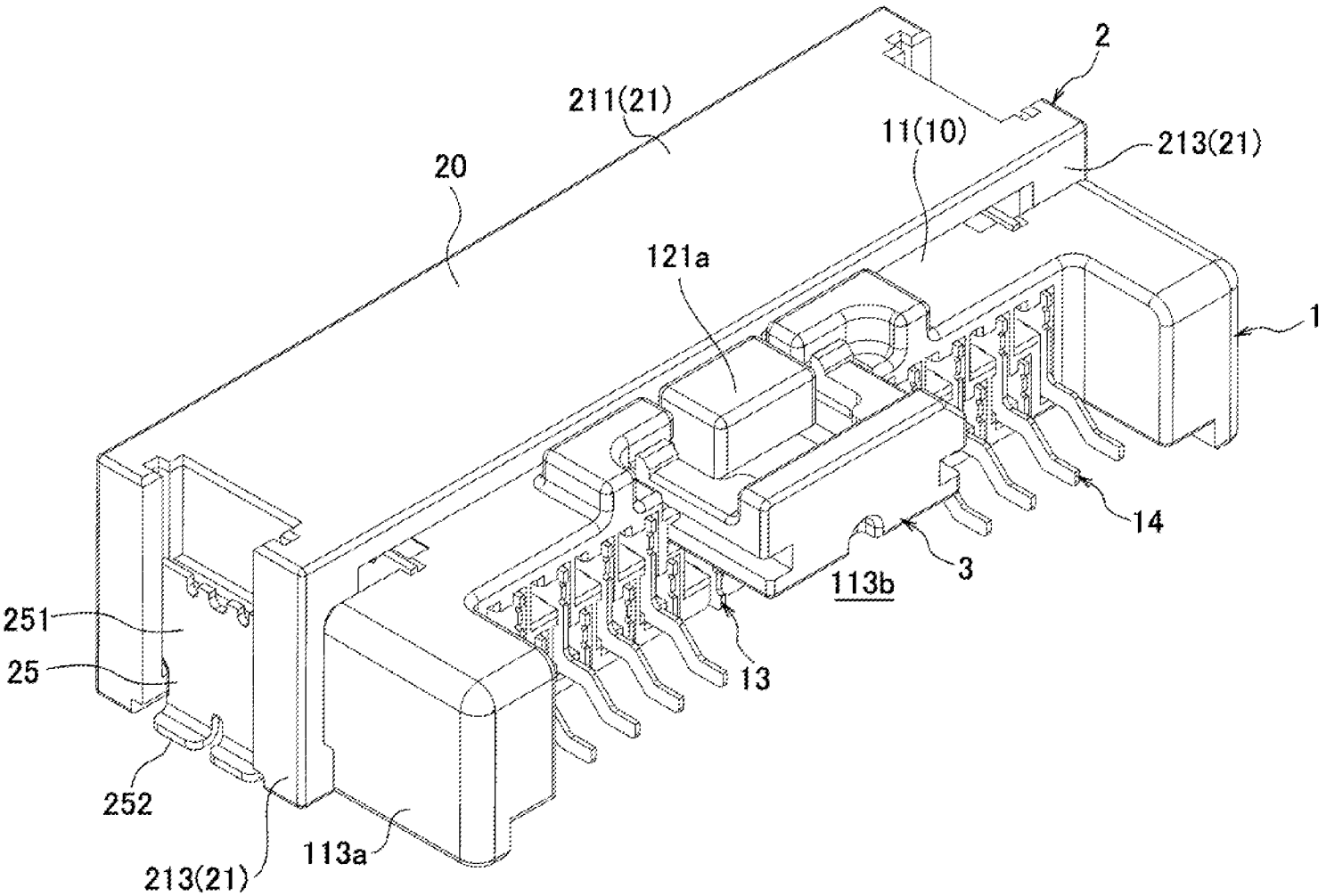
FIG. 6 is a perspective view explaining how the plug connector and the receptacle connector shown as an example are locked with the slide member and showing a state where the plug connector in which the slide member has been temporarily held has been fitted to the receptacle connector.
Figure 7:
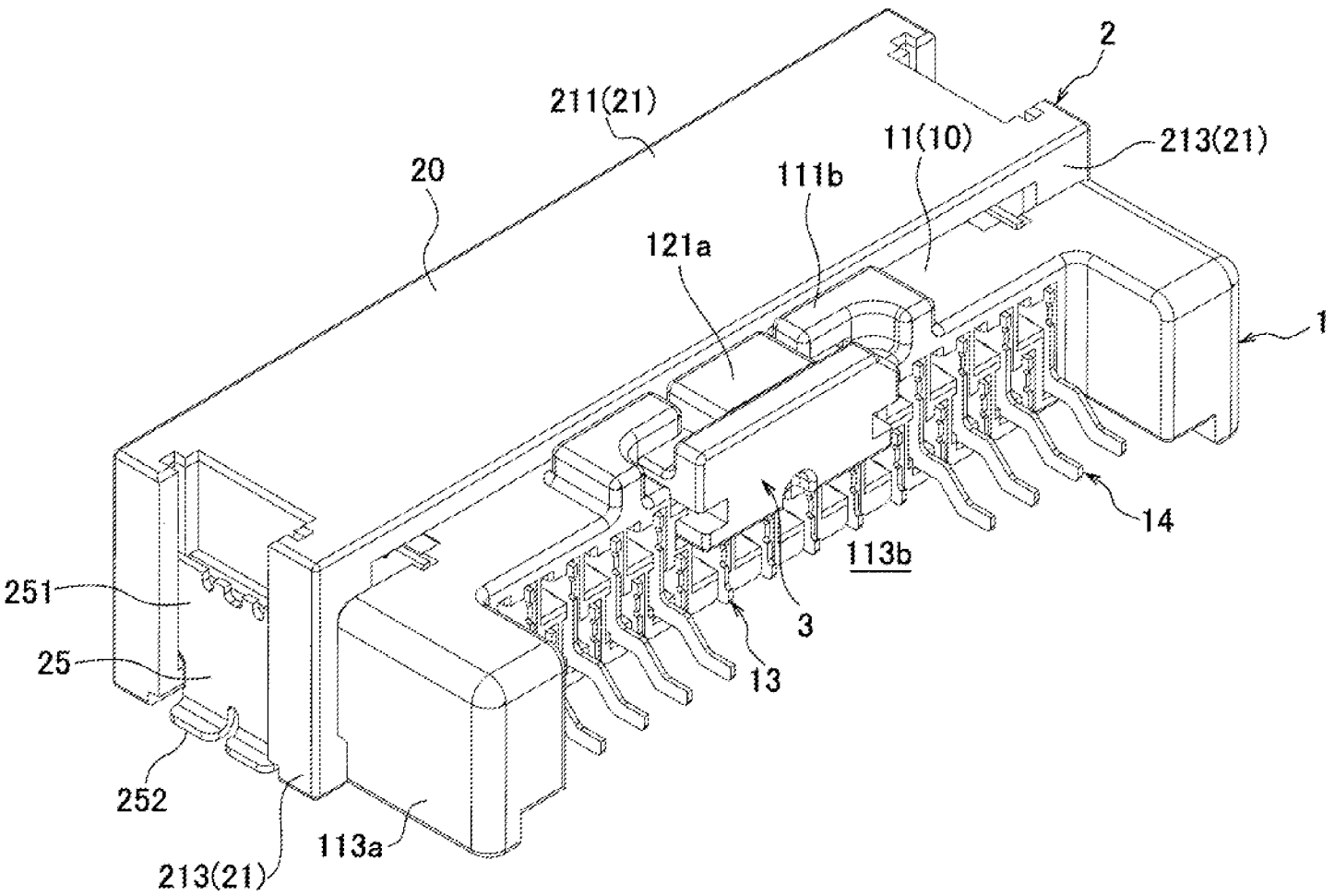
FIG. 7 is a perspective view explaining how the plug connector and the receptacle connector shown as an example are locked with the slide member and showing a state where the plug connector has been fitted to the receptacle connector and locked with the slide member.
Figure 8:
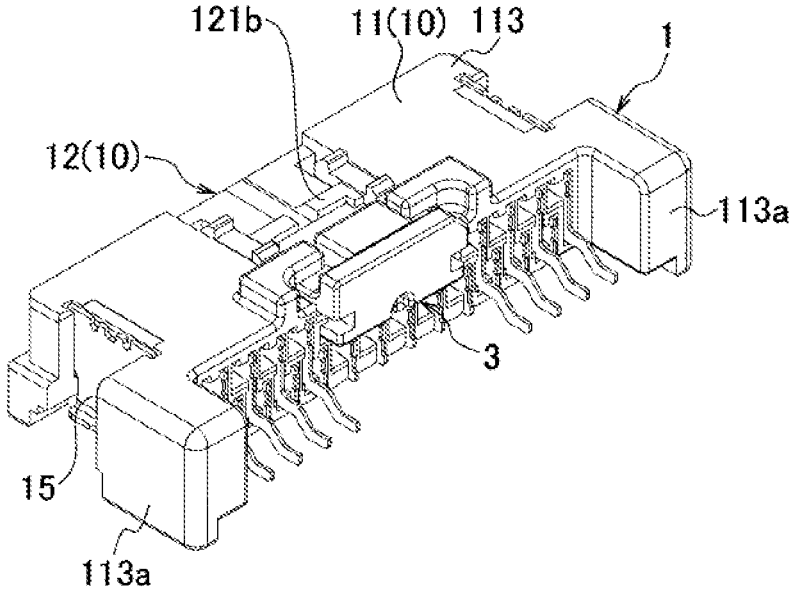
FIG. 8 is a perspective view showing a state before the plug connector in which the slide member has been temporarily held included in the connector set shown as an example is mounted on a cable.
Figure 8:
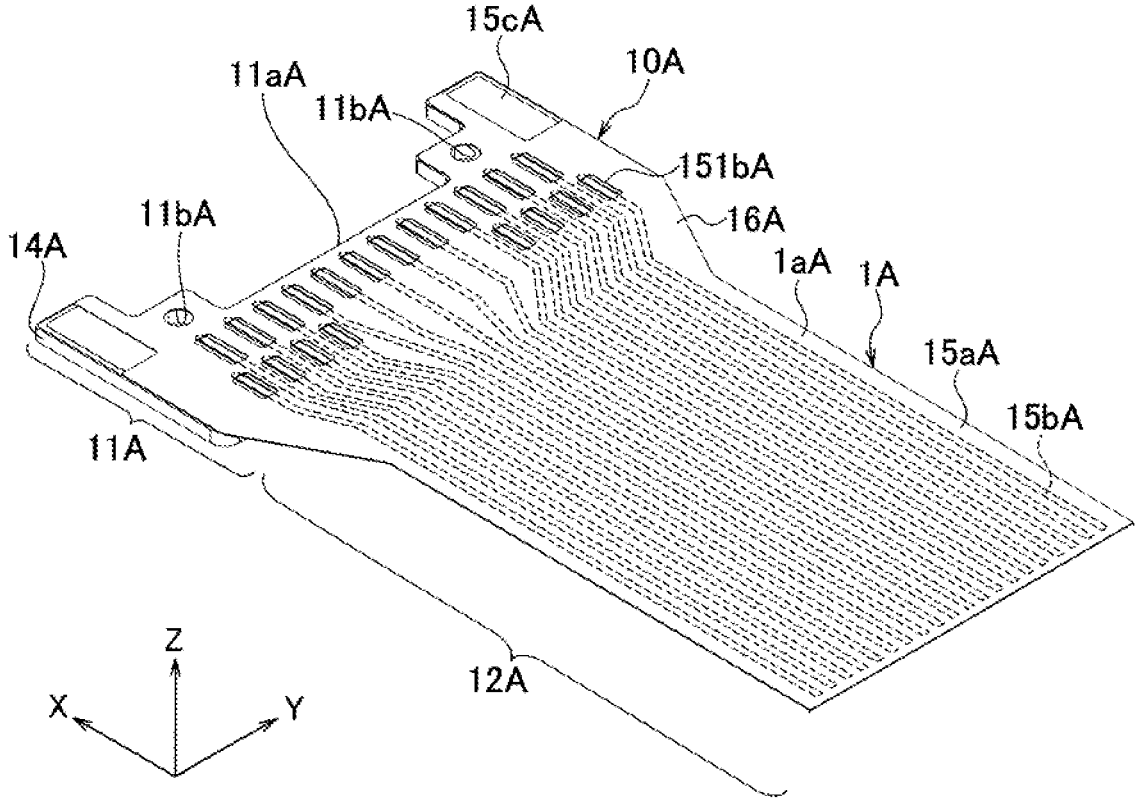
Figure 9A:
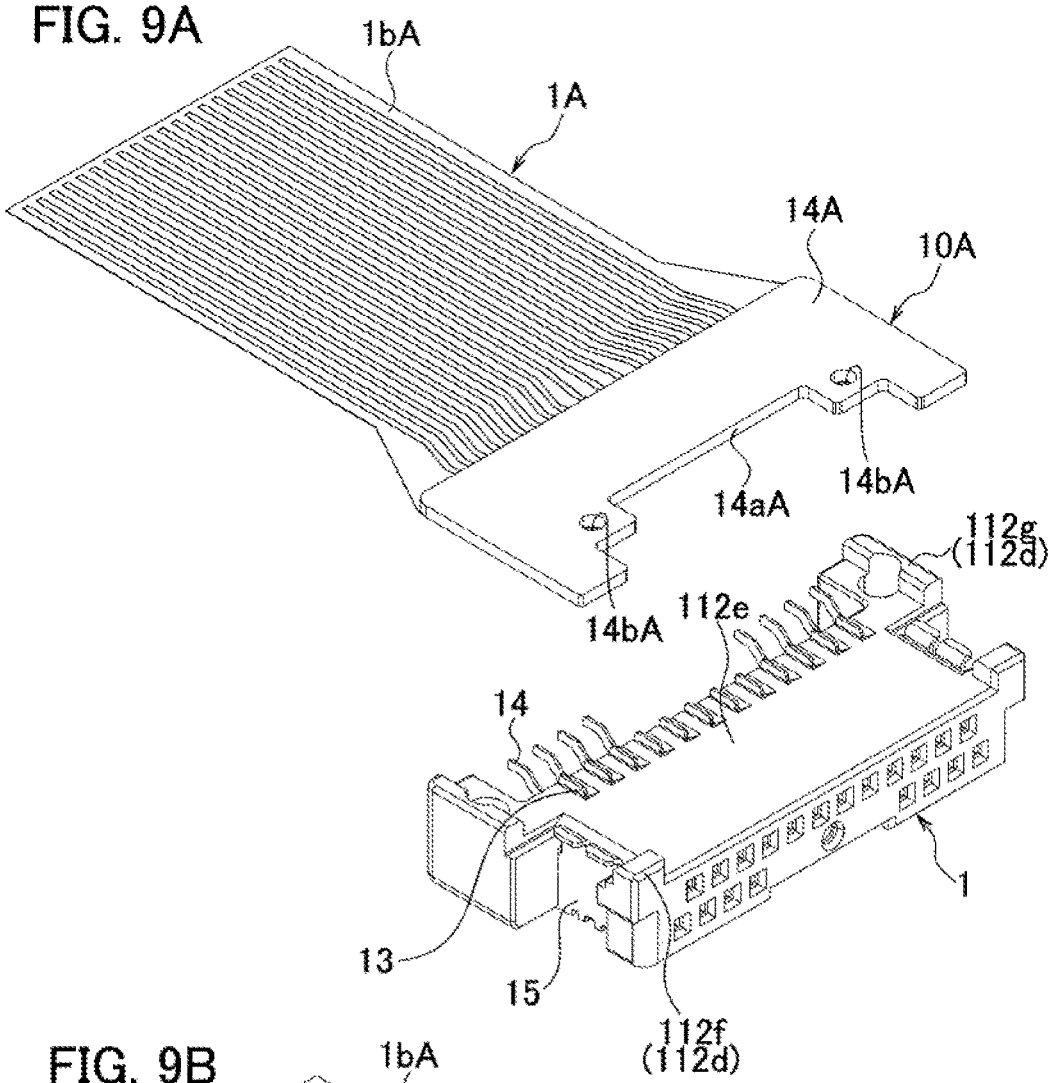
FIGS. 9A and 9B are perspective views explaining how the plug connector included in the connector set shown as an example is mounted on the cable, FIG. 9A showing a state viewed from the reverse side before the plug connector is mounted and FIG. 9B showing a state viewed from the reverse side after the plug connector is mounted.
Figure 9B:
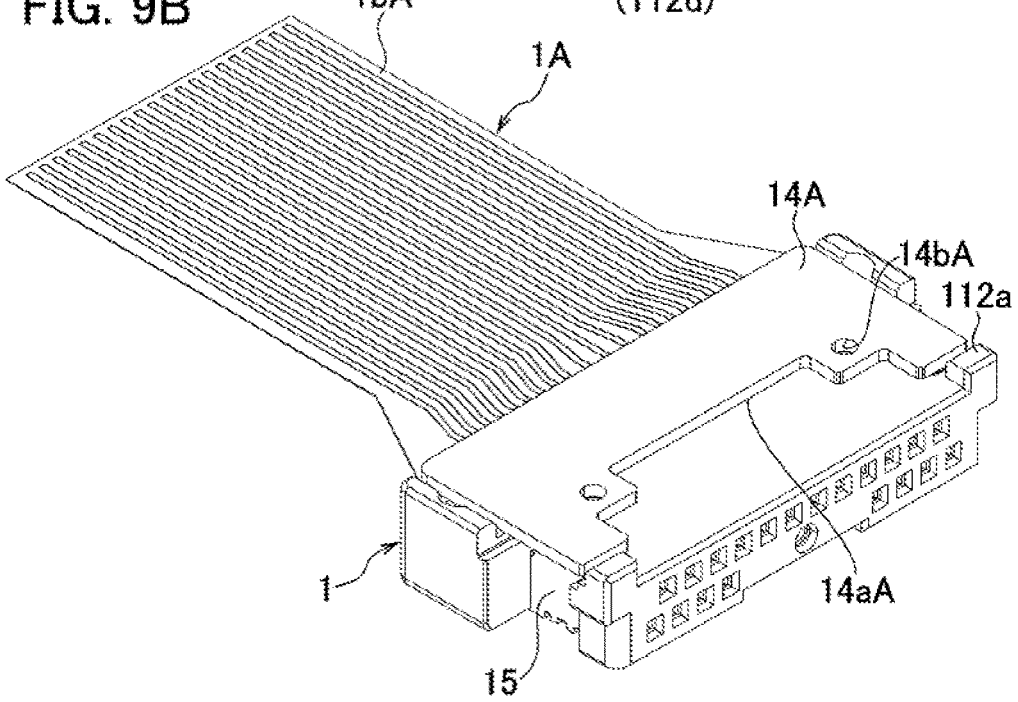
Figure 10:
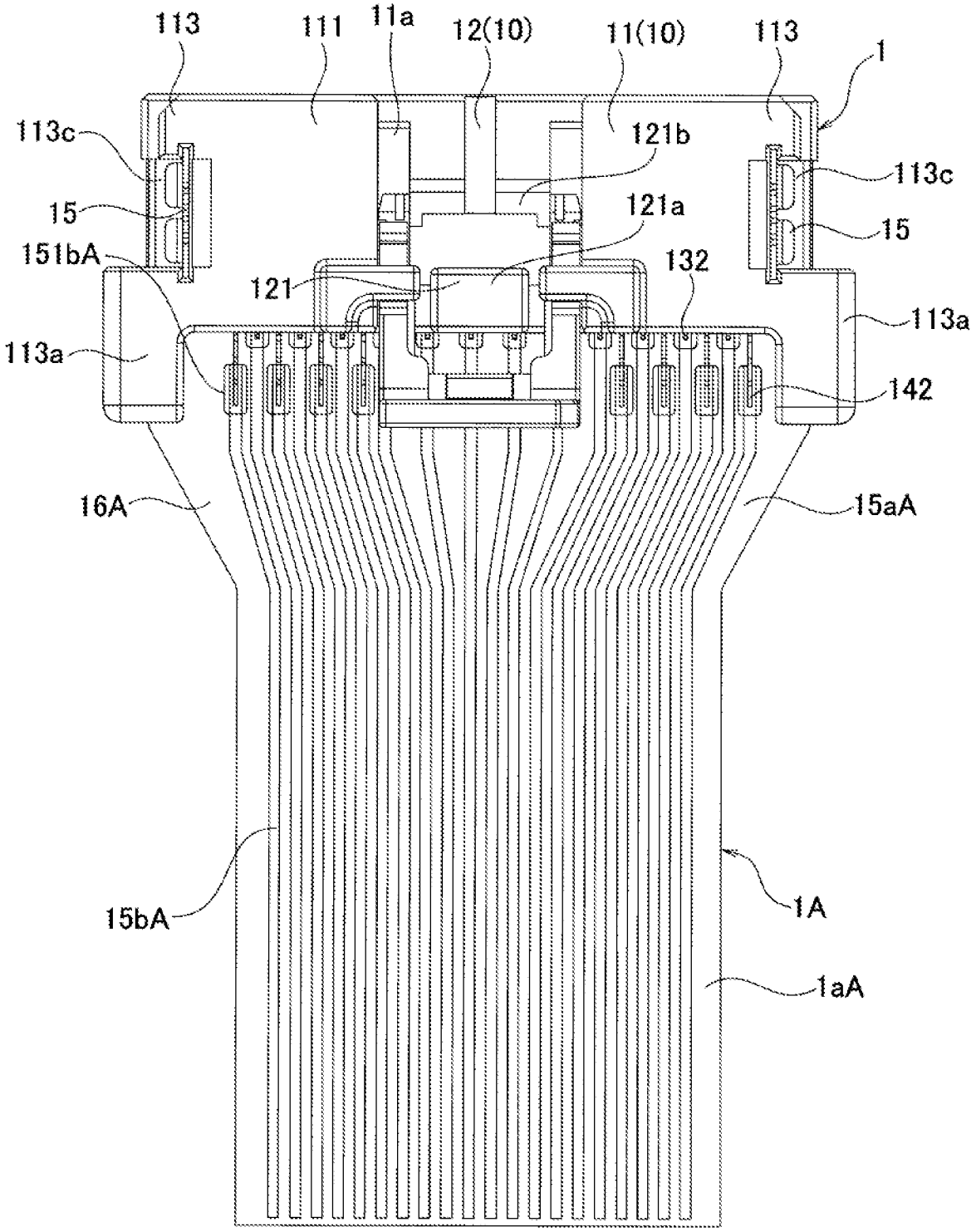
FIG. 10 is a plan view showing a state where the plug connector included in the connector set shown as an example is mounted on the cable.
Figure 11:
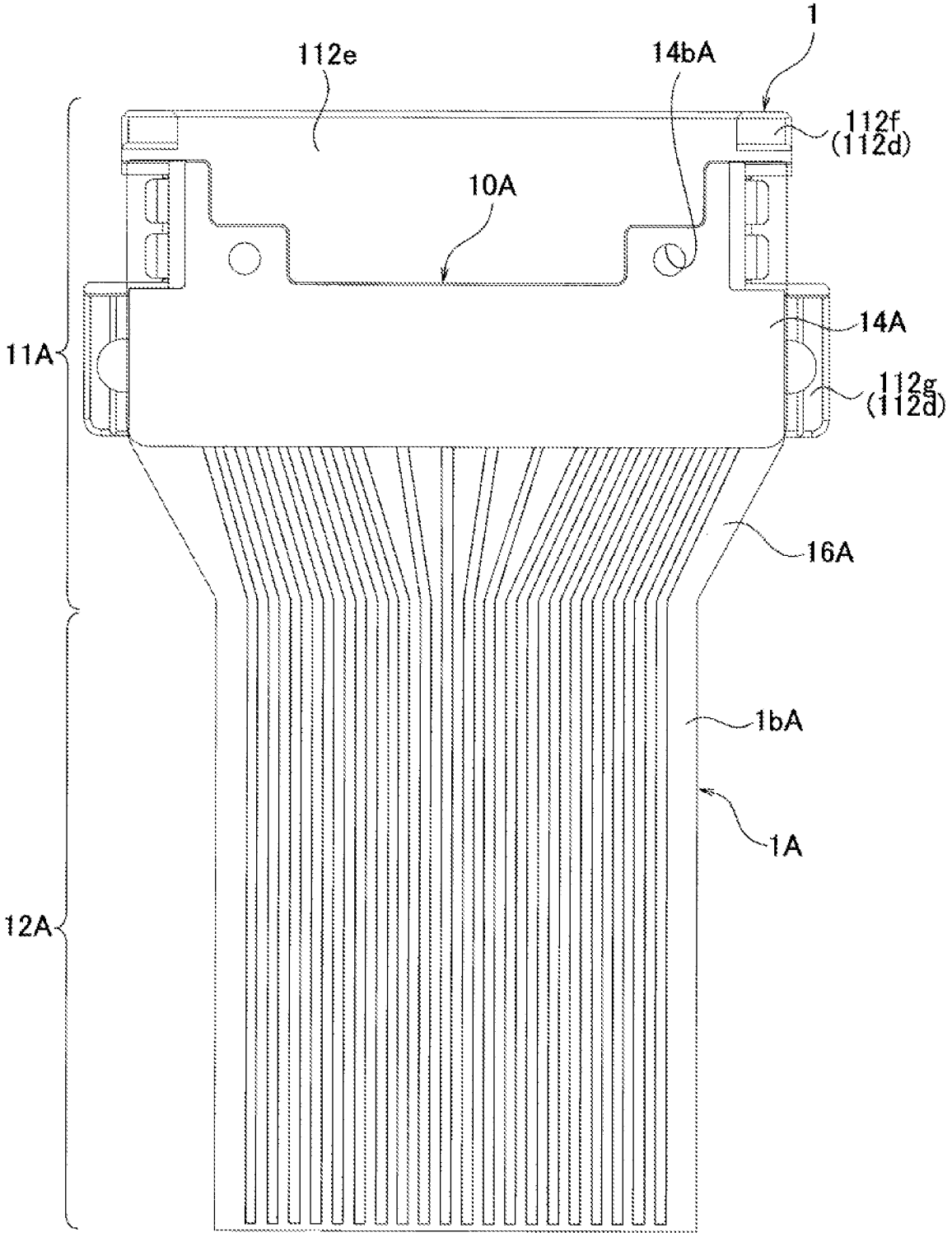
FIG. 11 is a reverse side view showing a state where the plug connector included in the connector set shown as an example is mounted on the cable.

Furthermore, in this embodiment, a slide member 3 is slidably supported on the plug connector 1 (see FIGS. 5 to 7).

This slide member 3 is slidably attached to the plug connector 1 such that the slide movement of the slide member 3 from an initial position which is a first position to a slide completion position which is a second position is restricted in a state where the plug connector 1 has not been completely fitted into the receptacle connector 2 yet. Note that the first position and the second position may be set as appropriate.

Then, the slide member 3 is configured such that once the plug connector 1 is completely fitted into the receptacle connector 2, the slide movement of the slide member 3 from the initial position to the slide completion position is allowed. This configuration makes it possible to check the completion of fitting between the plug connector 1 and the receptacle connector 2 from the sliding of the slide member 3 from the initial position to the slide completion position.

As described above, in this embodiment, the connector set C has a connector position assurance (CPA) function and the slide member 3 functions as a CPA member.

Configuration Example of Cable 1A

Next, with reference to FIGS. 8 to 11, description is given of a configuration example of the cable 1A on which the plug connector 1 is mounted.

The cable 1A has a sheet shape (flat plate shape) with a top surface (front surface: one side) 1*a*A and a rear surface (back surface: the other side) 1*b*A. The top surface 1*a*A serves as a mounting surface to mount the plug connector 1. The cable 1A is also flexible and thus can be bent (curved) in a cable thickness direction.

This cable 1A includes a connection region 11A used for connection with the plug connector 1 and an extension region 12A in which a conductor layer 15*b*A extends for wiring with another circuit.

In this embodiment, the cable 1A is formed such that the connection region 11A is positioned at one end side of the extension region 12A. In a state where the plug connector 1 having the connection region 11A connected thereto is fitted into the receptacle connector (receptacle connector 2 or receptacle connector 3), the extension region 12A is positioned on the opposite side of the receptacle connector.

Moreover, the cable 1A has a multilayer structure, including a support layer 15*a*A and the conductor layer 15*b*A supported by the support layer 15*a*A. The support layer 15*a*A is formed of a plurality of insulator films to cover the conductor layer 15*b*A. On the other hand, the conductor layer 15*b*A is formed of conductor films printed on the insulator films included in the support layer 15*a*A, which are a plurality of wiring patterns corresponding to the plurality of terminals (the lower plug terminals 13 and the upper plug terminals 14) to be described later, respectively.

On the upper surface of the connection region 11A, a plurality of conductor parts 151*b*A are formed, which are the conductor layer 15*b*A exposed from the support layer 15*a*A. The plurality of conductor parts 151*b*A are formed in two rows along the front-rear direction, and the conductor parts 151*b*A in each row are formed so as to be arranged at a predetermined pitch in the width direction (Y direction). Furthermore, in this embodiment, the plurality of conductor parts 151*b*A are formed in a staggered pattern in a plan view (state viewed along the mounting surface 1Aa).

Such a structure can be formed, for example, by printing the plurality of conductor films on the support layer 15*a*A to form the conductor layer 15*b*A and then covering the conductor layer 15*b*A with another support layer 15*a*A. In this event, another support layer 15*a*A is provided so as not to cover the tip of the conductor layer 15*b*A. Thus, the cable 1A having the tip of the conductor layer 15*b*A exposed on one side (top side of the top-bottom direction) is formed.

Note that a method for forming the cable 1A is not limited to the above method, but various other methods can be used to form the cable 1A.

On the upper surface of the connection region 11A, fixing parts 15*c*A are also formed to fix holding brackets 15 to be described later in the plug connector 1. In this embodiment, the cable 1A includes wide parts 16A extending on either side in the width direction (Y direction) of the plurality of conductor layers 15*b*A arranged in the width direction (Y direction), and a pair of fixing parts 15*c*A are formed on the tip side of the respective wide parts 16A (on the front side of the front-rear direction). These fixing parts 15*c*A can be formed, for example, in the same manner as the conductor layers 15*b*A in a printing process for the conductor layers 15*b*A.

In addition, in this embodiment, a cut-in portion 11*a*A which is elongated in the width direction (Y direction) and open to the front is formed in a step shape at the connection region 11A of the cable 1A. On both sides in the width direction (Y direction) of the cut-in portion 11*a*A at the connection region 11A are through holes 11*b*A formed to pass through the cable 1A in the cable thickness direction (top-bottom direction; Z direction).

Furthermore, in this embodiment, the cable 1A includes a reinforcing plate 14A. This reinforcing plate 14A is formed using glass epoxy resin, stainless steel, or the like, and is configured to reinforce the connection region 11A of the cable 1A by sandwiching the connection region 11A of the cable 1A between the reinforcing plate 14A and the plug connector 1.

The reinforcing plate 14A in this embodiment has a shape corresponding to the shape of; the connection region 11A of the cable 1A. In other words, the outline shape of the reinforcing plate 14A in plan view (as viewed along the mounting surface 1*a*A) is approximately the same as the outline shape of the connection region 11A. Thus, the reinforcing plate 14A has a cut-in portion 14*a*A elongated in the width direction (Y direction) and open to the front and through holes 14*b*A passing through the reinforcing plate 14A in the cable thickness direction (top-bottom direction; Z direction). Then, the reinforcing plate 14A is attached to the rear surface side of the connection region 11A with an adhesive or the like with the cut-in portion 11*a*A and the cut-in portion 14*a*A communicating with each other and with the through holes 11*b*A and the through holes 14*b*A communicating with one another.

In this event, it is preferable that the entire conductor part 151*b*A overlap with the reinforcing plate 14A in the plan view (state viewed along the mounting surface 1Aa). In this way, the entire conductor part 151*b*A is supported by the reinforcing plate 14A, and thus can be prevented from bending in the top-bottom direction (Z direction) or warping in the width direction (Y direction).

Configuration Example of Plug Connector 1

Next, with reference to FIGS. 12 to 16, description is given of a configuration example of the plug connector 1.

Figure 12:
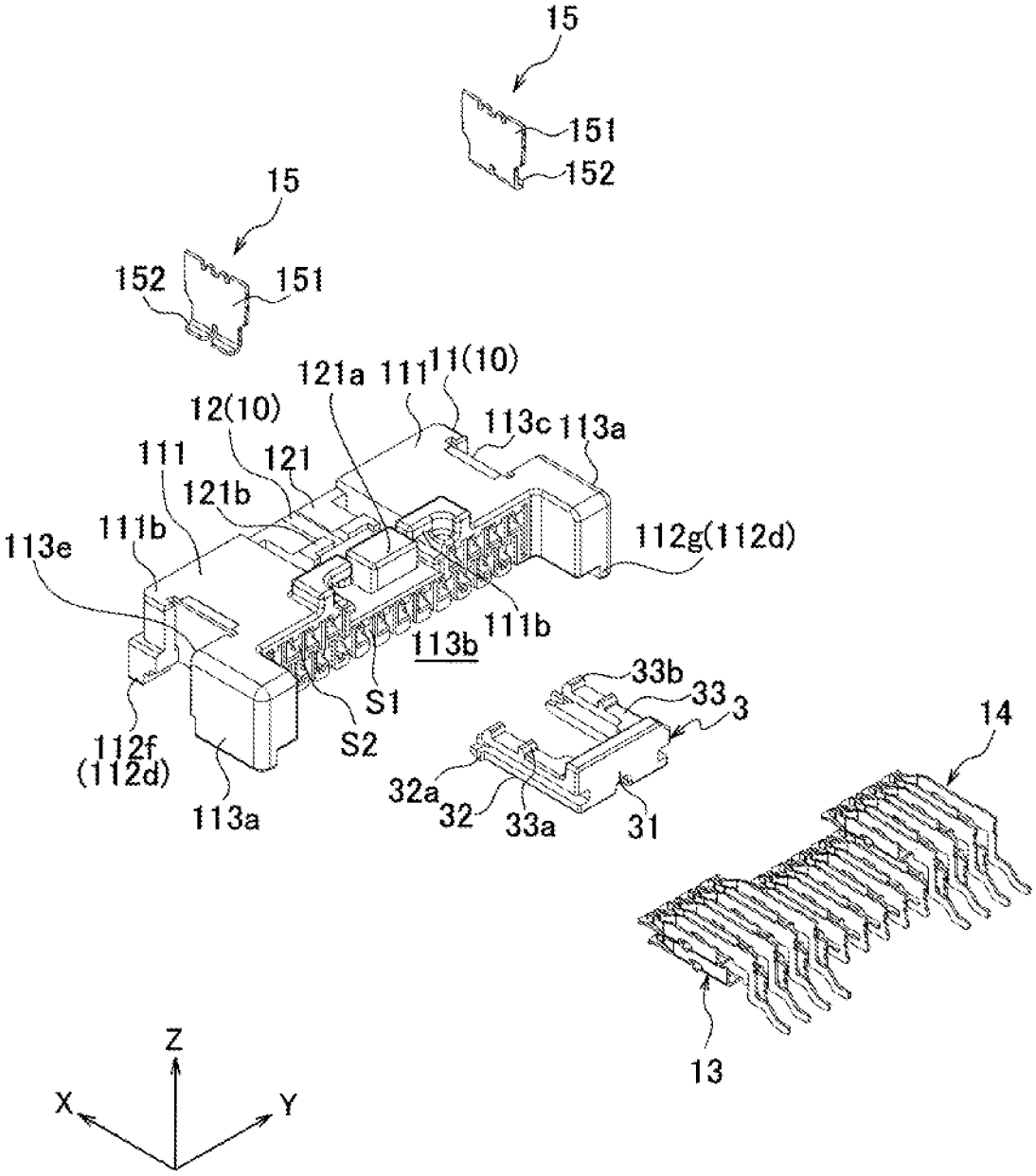
FIG. 12 is an exploded perspective view showing the plug connector and the slide member included in the connector set shown as an example.
Figure 13A:
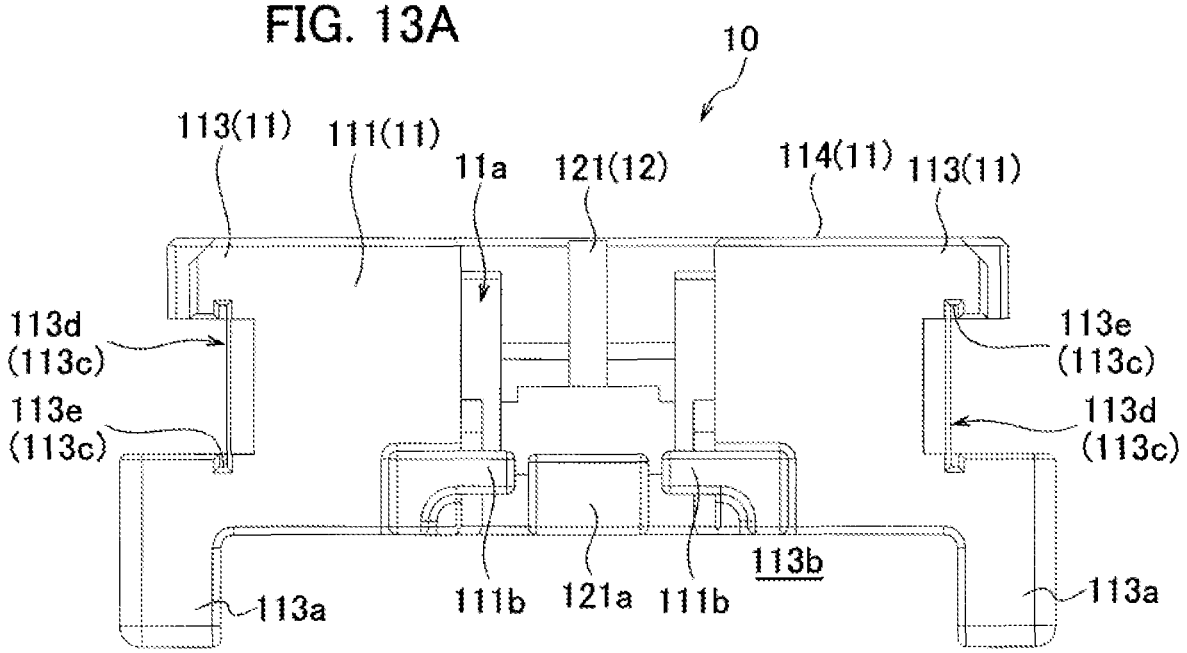
FIG. 13A is a plan view and FIG. 13B is a reverse side view, showing the plug housing included in the plug connector.
Figure 13B:
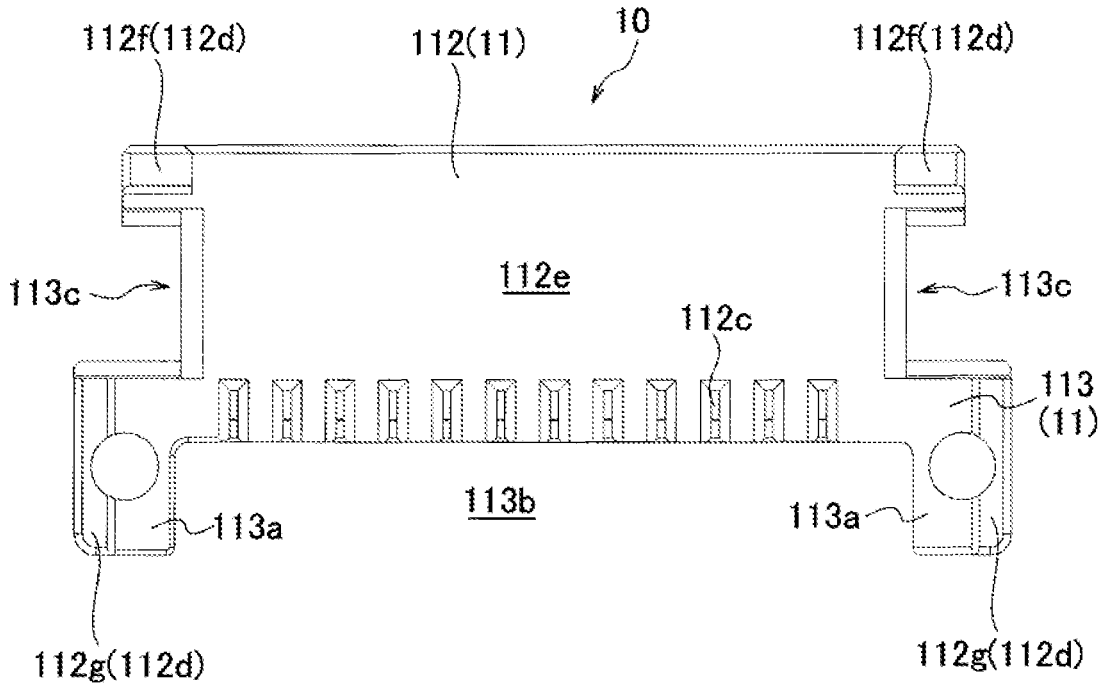

As shown in FIG. 12, the plug connector (connector) 1 includes a plug housing (housing) 10, plug terminals (terminals: lower plug terminals 13 and upper plug terminals 14) held by the plug housing 10, and the holding brackets 15 held by the plug housing 10.

The plug connector 1 is configured to be mounted on the cable 1A as the mounting member by mounting the plug terminals (lower plug terminals 13 and upper plug terminals 14) held by the plug housing 10 on the conductor part 151*b*A of the cable 1A disposed outside the plug housing 10. Note that the plug terminals (lower plug terminals 13 and upper plug terminals 14) are mounted on the conductor part 151*b*A by soldering or the like. The holding brackets 15 are fixed to the fixing parts 15*c*A of the cable 1A by soldering or the like, in a state where the holding brackets 15 are held by the plug housing 10, to fix the plug housing 10 to the cable 1A.

The plug housing 10 includes a rigid housing main body 11, and can be formed, for example, using an insulating resin material.

The housing main body 11 also has a lock part 12 formed on its upper side. This lock part 12 holds the plug housing 10 and the housing of the receptacle connector 2 in their fitted state or releases the fitted state.

Thus, in this embodiment, the plug housing 10 includes the housing main body 11 and the lock part 12 formed in the housing main body 11.

The housing main body 11 includes a top wall 111, a bottom wall 112, a pair of side walls 113 connecting both ends, in the width direction (Y direction), of the top wall 111 and the bottom wall 112, and a front wall 114 provided continuously from front ends of the top wall 111, the bottom wall 112, and the side walls 113, 113.

In addition, the housing main body 11 includes a partition walls 115 that is provided continuously from the pair of side walls 113 and the front wall 114 and partitions, into upper and lower parts, a space defined by the top wall 111, the bottom wall 112, the side walls 113, 113, and the front wall 114.

The housing main body 11 further includes a plurality of upper partition walls 116 provided continuously from the top wall 111, the partition wall 115, and the front wall 114. These upper partition walls 116 partition the upper space partitioned by the partition wall 115 into a plurality of spaces. The housing main body 11 also includes a plurality of lower partition walls 117 provided continuously from the bottom wall 112, the partition wall 115, and the front wall 114. These lower partition walls 117 partition the lower space partitioned by the partition wall 115 into a plurality of spaces.

The lock part 12 is formed in the middle, in the width direction, of the upper side of the housing main body 11. To be more specific, the top wall 111 is formed on either side in the width direction, and the upper partition wall 116 is provided continuously from the inner side, in the width direction, of each of the top walls 111. As described above, in this embodiment, the housing main body 11 has a shape in which the middle part in the width direction is recessed as viewed along the insertion direction (front-rear direction; X direction). The lock part 12 is formed in a recess part 11*a* formed in the middle, in the width direction, of this housing main body 11.

The lock part 12 includes a lever part 121 that is provided continuously from the front end of the partition wall 115 and extends rearward. This lever part 121 has its rear side capable of moving in the top-bottom direction relative to the partition wall 115 (housing main body 11). The lever part 121 has an operation part 121*a* formed at its rear end to operate the lever part 121, and also has an engagement protrusion 121*b* formed in its central portion in the front-rear direction to engage with an engagement recess part (engaged part) 221*a* formed in the receptacle connector 2.

In this embodiment, when the plug housing 10 and the receptacle housing 20 of the receptacle connector 2 are fitted together, the housings of the respective connectors can be locked together (maintained in the fitted state) by the engagement protrusion 121*b* engaging with the engagement recess part 221*a*. Then, the fitted state of the housings of the respective connectors can be released by lowering the operation part 121*a* of the lever part 121 to move downward the lever part 121 as well as the engagement protrusion 121*b*, thus releasing the engagement with the engagement recess part 221*a*.

Furthermore, an insertion space S6 into which the slide member 3 is inserted is formed on either side, in the width direction, of the lever part 121 in the recess part 11*a*. In addition, below the lever part 121 in the recess part 11*a* (between the lever part 121 and the partition wall 115), a deflection allowance space S7 is formed where downward deflection of the lever part 121 (the movement of the lever part 121 relative to the housing main body 11) is allowed.

Note that the insertion space S6 is partitioned into a space into which a lower arm part 32 of the slide member 3 to be described later is inserted and a space into which an upper arm part 33 of the slide member 3 is inserted, by a protrusion wall 116*a* formed to protrude in the width direction on the upper partition wall 116 which defines the recess part 11*a*.

Figure 25:
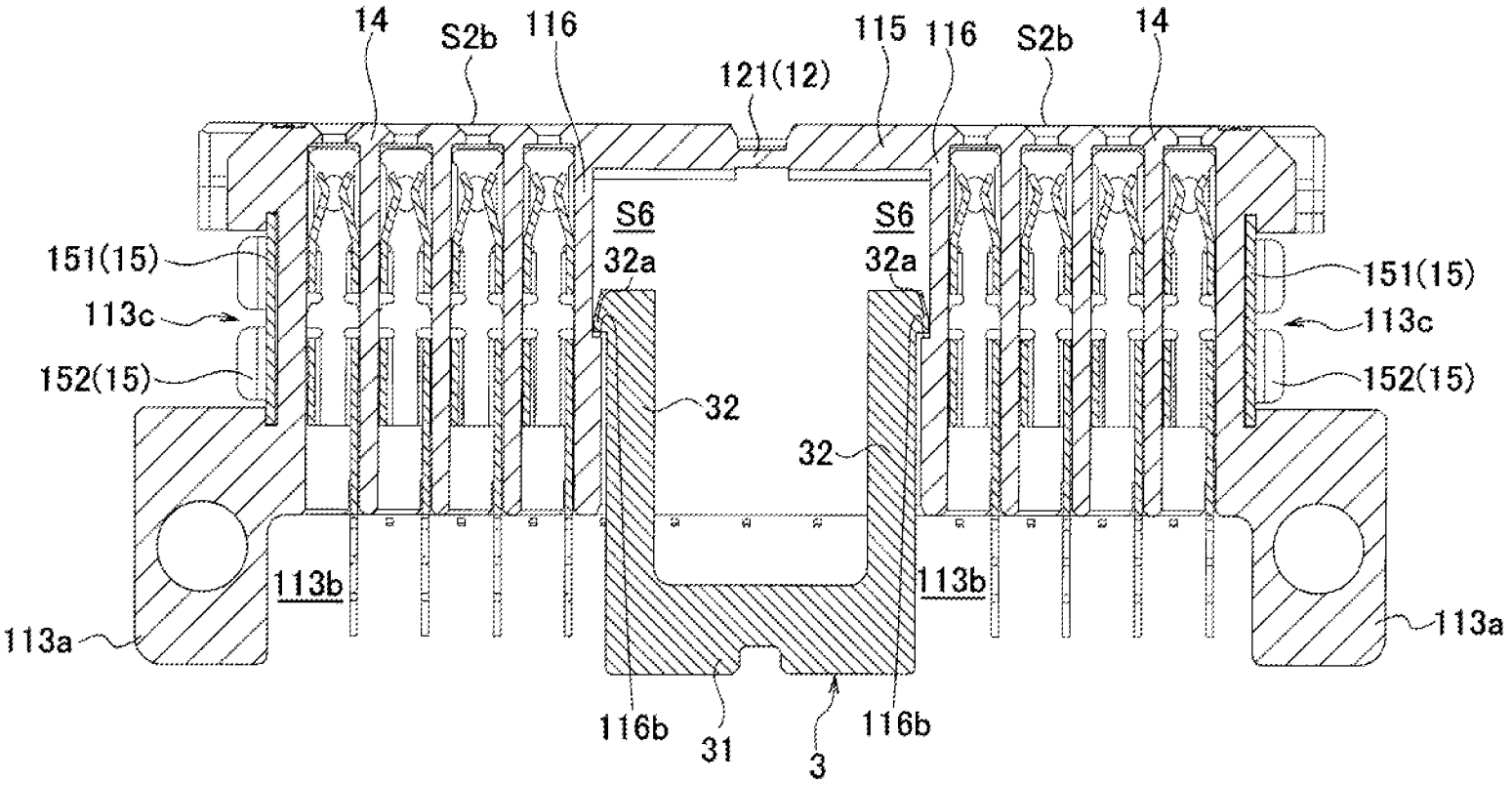
FIG. 25 is a horizontal sectional view showing a state where the slide member is temporarily held in the plug connector shown as an example.

In addition, a step part 116*b* is formed in the middle in the front-rear direction, below the protrusion wall 116*a* of the upper partition wall 116 which defines the recess part 11*a*. A space into which the lower arm part 32 is inserted is formed to have a wider front side in a plan view (see FIG. 25). Locking a locking protrusion 32*a* that is formed to protrude outward in the width direction on the tip (front end) of the lower arm part 32 to the step part 116*b* prevents the slide member 3 from falling off the housing main body 11.

In rear parts of the top walls 111, restrictive protrusions (slide restrictor) 111*b* each having a substantially L-shape in a plan view are formed. The restrictive protrusions 111*b* prevent the slide member 3 from sliding from the initial position to the slide completion position in the state where the plug housing 10 has not been completely fitted into the receptacle housing 20 yet.

Also, the front wall 114 has through-holes 114*a* formed therein, which communicate with the plurality of spaces partitioned by the partition wall 115 and the upper and lower partition walls 116 and 117. Thus, in this embodiment, the plurality of spaces penetrating in the front-rear direction are formed in the housing main body 11. Then, the plug terminals (lower plug terminals 13 and upper plug terminals 14) are press-fitted (inserted) into the spaces penetrating in the front-rear direction.

In this embodiment, a plurality of spaces arranged in the width direction (Y direction) are formed in two stages in the top-bottom direction (Z direction) in the housing main body 11. These plurality of spaces are formed in a staggered pattern when viewed from the rear side in the front-rear direction of the housing main body 11. Accordingly, the plug connector 1 is reduced in size in the width direction.

To be more specific, on the lower side (mounting surface 1*a*A side) of the housing main body 11, a plurality of spaces defined by the bottom wall 112, the partition wall 115, and the lower partition walls 117 are arranged in the width direction (Y direction). These spaces formed on the lower side (mounting surface 1*a*A side) of the housing main body 11 serve as first spaces S1 into which lower plug terminals 13 are press-fitted (inserted).

On the other hand, on the upper side (position further away from the mounting surface 1*a*A than the first spaces S1) of the housing main body 11, a plurality of spaces defined by the top wall 111, the partition wall 115, and the upper partition walls 116 are arranged in the width direction (Y direction). These spaces formed on the upper side of the housing main body 11 serve as second spaces S2 into which upper plug terminals 14 are press-fitted (inserted).

In this embodiment, in a lower part of the housing main body 11, 12 spaces (lower spaces S1) are arranged in the width direction. On the other hand, in an upper part of the housing main body 11, 4 spaces (upper spaces S2) are arranged at one side of the lock part 12 in the width direction and 4 spaces (upper spaces S2) are arranged at the other side of the lock part 12 in the width direction. In other words, in the upper part of the housing main body 11, 8 spaces (upper spaces S2) are arranged in the width direction in such a manner as to sandwich the lock part 12. Accordingly, the housing main body 11 is reduced in size in the height dimension.

Furthermore, in this embodiment, the upper partition walls 116 and the lower partition walls 117 are formed at positions shifted from each other in the width direction. More specifically, the first spaces S1 and the second spaces S2 are formed so as to partially overlap with each other in the plan view. In other words, the first spaces S1 and the second spaces S2 overlap with each other, when the plug housing 10 is viewed along a direction (top-bottom direction) normal to the mounting surface 1*a*A, in a state where the plug terminals (lower plug terminals 13 and upper plug terminals 14) are held by the plug housing 10 and also mounted on the cable 1A.

Note that in this embodiment, the insertion space S6 and the second space S2 are placed over each other when the plug housing 10 is viewed in the width direction. This enables a low height of the plug housing 10 holding the slide member 3.

The lower plug terminals 13 are each configured to be press-fitted (inserted) forward from an opening at the rear end side of the first space S1. This opening at the rear end side of the first space S1 serves as an insertion opening (insertion slot) S1*a*. Also, an opening at the front end side of the first space S is formed to be smaller than the insertion opening S1*a* so as to prevent the lower plug terminal 13 from falling off. More specifically, forward movement of the lower plug terminal 13 press-fitted (inserted) from the insertion opening S1*a* is restricted by the front wall 114. Note that the opening at the front end side of the first space S1 serves as an introduction port S1*b* for introducing a contact portion 230*a* of the lower receptacle terminal 23 of the receptacle connector 2 to be described later into the first space S. This introduction port S1*b* has its peripheral portion formed into a tapered shape so as to facilitate introduction of the contact portion 230*a* of the lower receptacle terminal 23.

Likewise, the upper plug terminals 14 are each configured to be press-fitted (inserted) forward from an opening at the rear end side of the second space S2. This opening at the rear end side of the second space S2 serves as an insertion opening (insertion slot) S2*a*. Also, an opening at the front end side of the second space S2 is formed to be smaller than the insertion opening S2*a* so as to prevent the upper plug terminal 14 from falling off. More specifically, forward movement of the upper plug terminal 14 press-fitted (inserted) from the insertion opening S2*a* is restricted by the front wall 114. Note that the opening at the front end side of the second space S2 serves as an introduction port S2*b* for introducing a contact portion 240*a* of the upper receptacle terminal 24 of the receptacle connector 2 to be described later into the second space S2. This introduction port S2*b* has its peripheral portion formed into a tapered shape so as to facilitate introduction of the contact portion 240*a* of the upper receptacle terminal 24.

Moreover, in the lower part of the top wall 111, grooves 111*a* opened rearward and downward are formed to communicate with the second space S2. These grooves 111*a* guide press-fitting (insertion) of the upper plug terminals 14 into the second space S2 by insertion of upper ends of side walls 144 of the upper plug terminals 14 to be described later into the grooves 111*a*.

In this embodiment, the grooves 111*a* are formed on either side, in the width direction, of the second space S2 so as to extend from the insertion openings S2*a* to the front wall 114.

More specifically, the grooves 111*a* are formed such that the length in the insertion direction (X direction) is not less than a distance the upper plug terminals 14 move during the period from the start of insertion of upper ends of side walls 144 into the grooves 111*a* through until the insertion is completed. Therefore, a portion of the upper end of the side wall 144 first inserted into the groove 111*a* stays inside the groove 111*a* during the period from the start of the insertion into the groove 111*a* through until the press-fitting (insertion) of the upper plug terminal 14 into the second space S2 is completed.

Note that the grooves 111*a* are formed to have a groove width (length in the Y direction) slightly larger than the thickness of the side wall 144.

Likewise, in the lower part of the partition wall 115, grooves 115*a* opened rearward and downward are formed to communicate with the first space S1. These grooves 115*a* guide press-fitting (insertion) of the lower plug terminals 13 into the first space S1 by insertion of the upper ends of the side walls 134 of the lower plug terminals 13 to be described later into the grooves 115*a*.

In this embodiment, the grooves 115*a* are also formed on either side, in the width direction, of the first space S1 so as to extend from the insertion openings S1*a* to the front wall 114.

More specifically, the grooves 115*a* are formed such that the length in the insertion direction (X direction) is not less than a distance the lower plug terminals 13 move between the start of the insertion of the upper ends of the side walls 134 into the grooves 115*a* and the end of the insertion. Therefore, a portion of the upper end of the side wall 134 first inserted into the groove 115*a* stays inside the groove 115*a* until the press-fitting (insertion) of the lower plug terminal 13 into the first space S1 is completed after the start of the insertion thereof into the groove 115*a*.

Note that the grooves 115*a* are formed to have a groove width (length in the Y direction) slightly larger than the thickness of the side wall 134.

Furthermore, in this embodiment, a groove 115*b* extending in the top-bottom direction and having both ends opened into the first and second spaces S1 and S2, respectively, is formed at the rear end of the partition wall 115. To be more specific, the groove 115*b* is formed so as to face, in the top-bottom direction, one of the two grooves 111*a* (the one on the right side in FIG. 14B) formed so as to communicate with one of the second spaces S2.

Figure 14A:
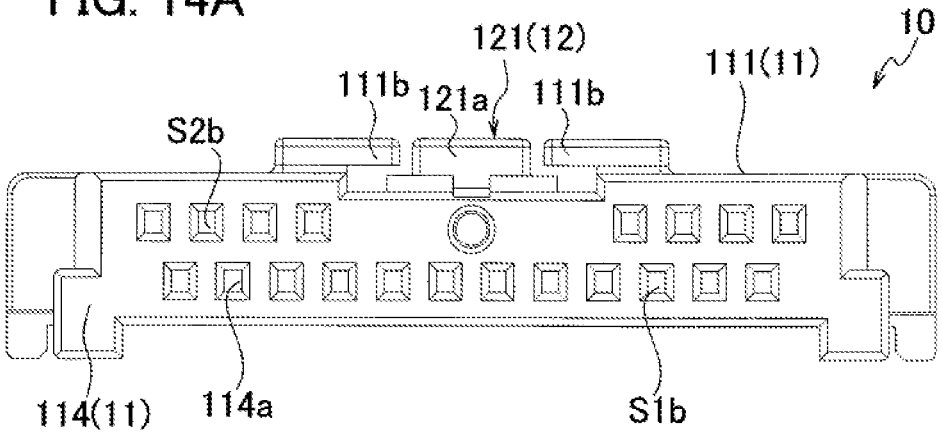
FIG. 14A is a front view.
Figure 14B:
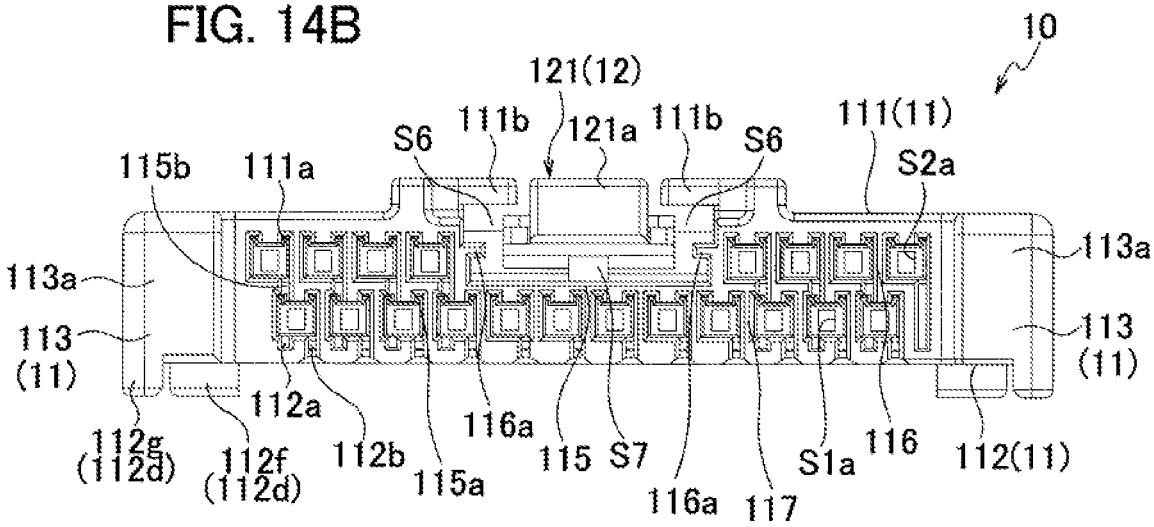
Figure 14C:
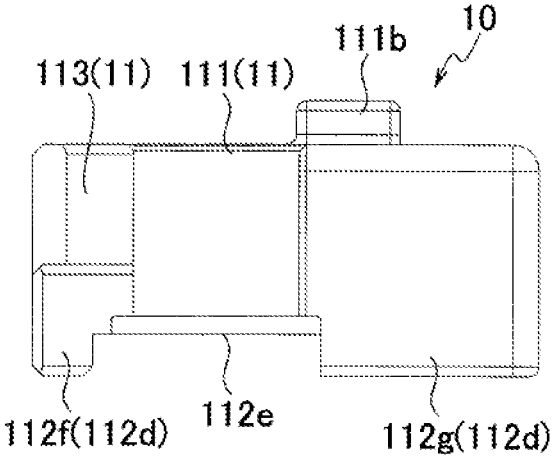
Figure 14D:
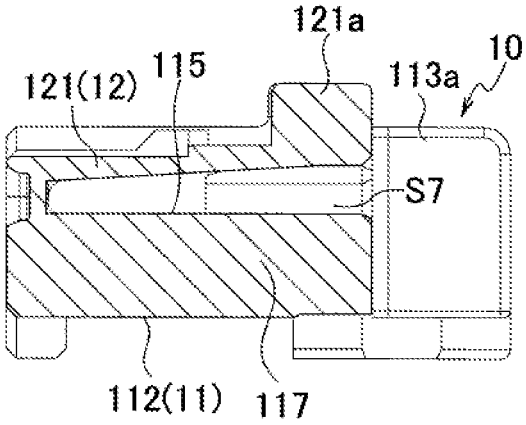
Figures 15A, 15B, 15C, 15D, 15E, 15F:
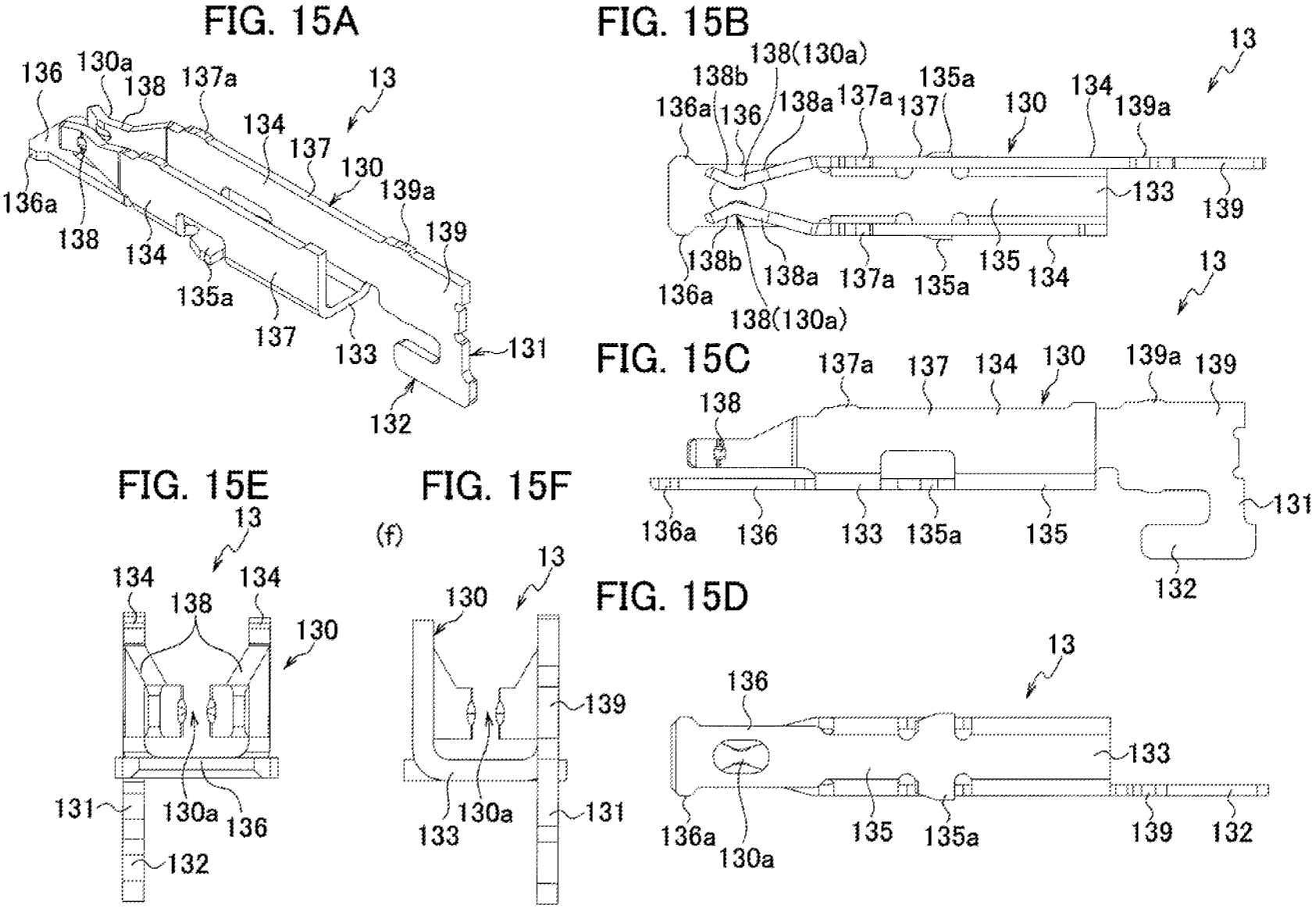
FIG. 15A is a perspective view.
FIG. 15B is a plan view.
FIG. 15C is a side view.
FIG. 15D is a reverse side view.
FIG. 15E is a front view.
FIG. 15F is a back view, showing the lower plug terminal included in the plug connector.
Figures 16A, 16B, 16C, 16D, 16E, 16F:
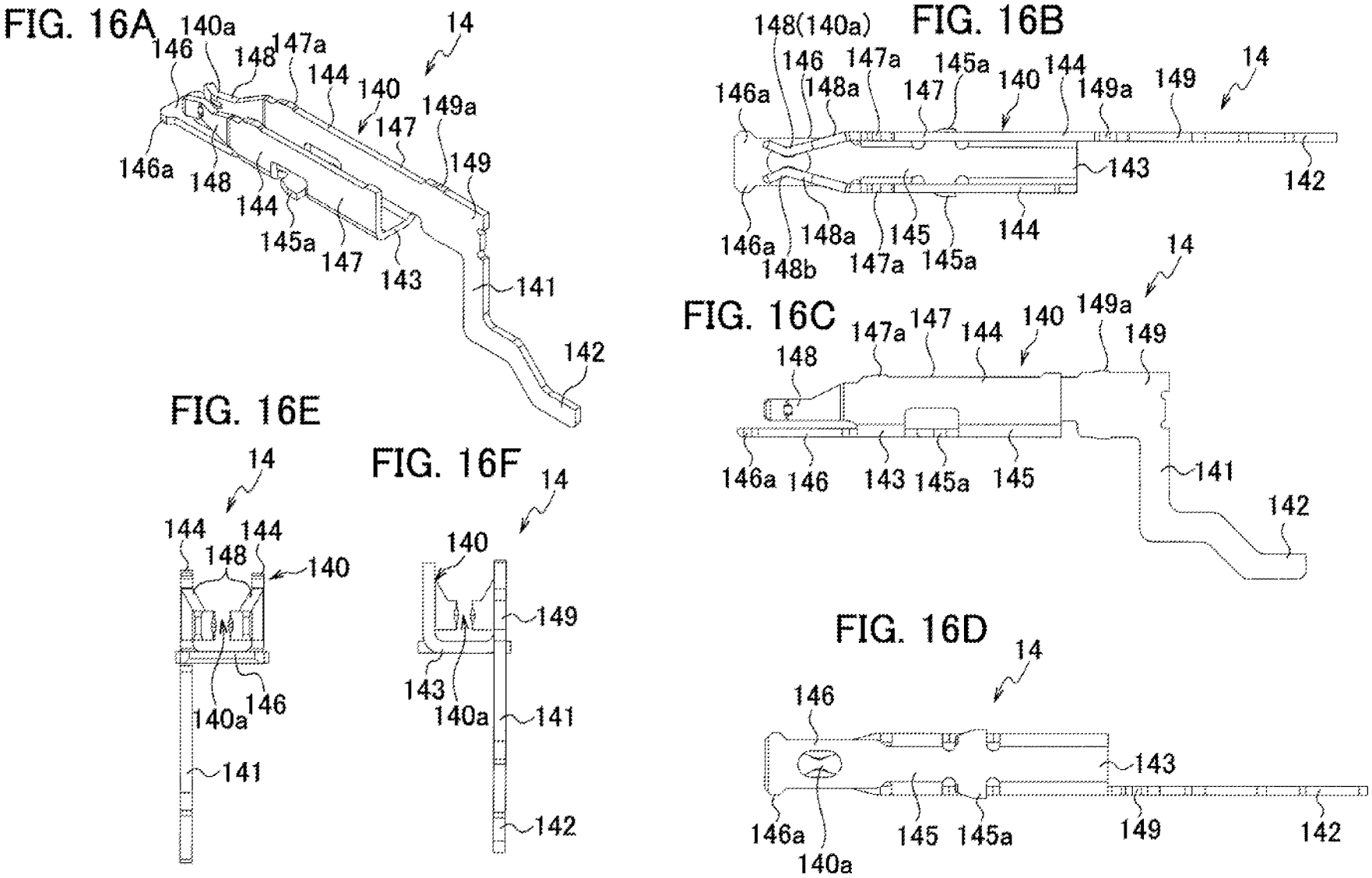
FIG. 16A is a perspective view.
FIG. 16B is a plan view.
FIG. 16C is a side view.
FIG. 16D is a reverse side view.
FIG. 16E is a front view.
FIG. 16F is a back view, showing the upper plug terminal included in the plug connector.

More specifically, as shown in FIG. 14B, the groove 115*b* is aligned in the top-bottom direction with one of the grooves 111*a* (the one on the right side in FIG. 14B) when the plug housing 10 is viewed from the rear side in the front-rear direction. A leg part 141 of the press-fitted (inserted) upper plug terminal 14 has its upper part inserted into this groove 115*b*.

Moreover, a groove 112*a* extending in the top-bottom direction and having its upper end opened into the first space S1 is formed at the rear end of the bottom wall 112. To be more specific, the groove 112*a*, one of the grooves 111*a* (the one on the right side in FIG. 14B), and the groove 115*b* are arranged so as to be aligned in the top-bottom direction with each other when the plug housing 10 is viewed from the rear side in the front-rear direction. The leg part 141 of the press-fitted (inserted) upper plug terminal 14 has its lower part inserted into this groove 112*a*.

Furthermore, a groove 112*b* extending in the top-bottom direction and having both ends opened into the first space S1 and below the plug housing 10, respectively, is formed at the rear end of the bottom wall 112. To be more specific, the groove 112*b* is formed so as to face, in the top-bottom direction, one of the two grooves 115*a* (the one on the right side in FIG. 14B) formed so as to communicate with one of the first spaces S1.

More specifically, as shown in FIG. 14B, the groove 112*b* is aligned in the top-bottom direction with one of the grooves 115*a* (the one on the right side in FIG. 14B) when the plug housing 10 is viewed from the rear side in the front-rear direction. A leg part 131 of the press-fitted (inserted) lower plug terminal 13 is inserted into this groove 112*b*.

Moreover, a recess part 112*c* that is opened downward and rearward and extends in the front-rear direction is formed at the rear end part of the bottom wall 112. In this recess part 112*c*, a first mounting piece 132 of the press-fitted (inserted) lower plug terminal 13 is received.

Furthermore, extension parts 113*a*, 113*a* extending rearward are formed on the pair of side walls 113, 113, respectively. A region where the extension parts 113*a*, 113*a* face each other serves as a recess part 113*b* that houses first and second mounting pieces 132 and 142 of the plug terminals 13 and 14.

As described above, in this embodiment, the first and second mounting pieces 132 and 142 of the plug terminals 13 and 14 are mounted on the conductor part 151*b*A of the cable 1A at the position closer to the front than the rear ends of the extension parts 113*a*, 113*a*. In this event, the connection region 11A of the cable 1A is sandwiched between the extension parts 113*a*, 113*a* and the reinforcing plate 14A.

In this way, when the cable 1A is fanned to move away from the reinforcing plate 14A, the cable 1A and the reinforcing plate 14A can be more surely suppressed from coming off each other. Furthermore, since the first and second mounting pieces 132 and 142 of the plug terminals 13 and 14 are positioned closer to the front than the tips (rear ends) of the extension parts 113*a*, 113*a*, the first and second leg parts 131 and 141 of the plug terminals 13 and 14 as well as the first and second mounting pieces 132 and 142 can be prevented from being deformed by fanning of the cable 1A. More specifically, the mounting parts between the cable 1A and the plug terminals 13 and 14 can be protected from fanning of the cable 1A.

Moreover, at the front ends of the pair of side walls 113, 113, holding bracket attachments 113*c*, 113*c* are formed, respectively, to hold the holding brackets 15.

In this embodiment, the holding bracket attachment 113*c* includes: a recess part 113*d* opened outward in the top-bottom direction and in the width direction: and slits 113*e*, 113*e* provided continuously inward, in the width direction, of the recess part 113*d*, into which both ends, in the front-rear direction, of a main body part 151 of the holding bracket 15 is inserted. In a state where the holding brackets 15 are held by the plug housing 10, fixing pieces 152 provided continuously from lower ends of the main body parts 151 are fixed to the fixing parts 15*c*A of the cable 1A, thereby fixing the plug housing 10 to the cable 1A.

Moreover, at the lower side (rear surface side) of the bottom wall 112, a protrusion 112*d* extending in the width direction is formed so as to protrude downward. By forming such a protrusion 112*d* in the bottom wall 112, a recess part 112*e* is formed in the lower surface of the bottom wall 112. When the plug connector 1 is mounted on the cable 1A, the connection region 11A having the reinforcing plate 14A attached thereto is housed in the recess part 112*e* (see FIG. 9B). As described above, in this embodiment, the connection region 11A to which the reinforcing plate 14A is attached serves as a for-connection portion 10A which is housed and held in the recess part 112*e*. The protrusions 112*d* are formed on the bottom wall 112 such that the amount of protrusion is larger than or equal to the thickness of the for-connection portion 10A (the sum of the thicknesses of the cable 1A and the reinforcing plate 14A).

As described above, in this embodiment, the plug housing 10 includes a pair of walls (top wall 111 and bottom wall 112) facing each other in the housing thickness direction (top-bottom direction: Z direction). Then, the recess part 112*e* which houses the for-connection portion 10A (the connection region 11A to which the reinforcing plate 14A is attached) of the cable 1A is formed on the bottom wall 112 which is the wall on one side of the pair of walls (top wall 111 and bottom wall 112). More specifically, the plug housing 10 has a receiving part (recess part 112*c*) to receive the cable (mounting member) 1A in the wall (bottom wall 112) on one side in the housing thickness direction (top-bottom direction).

With this configuration, when the plug housing 10 is being fitted into the receptacle housing 20, the lower ends of the protrusions 12*d* slide on an inner surface of the receptacle housing 20. Specifically, this configuration prevents the for-connection portion 10A of the cable 1A from interfering with the receptacle housing 20 when the plug housing 10 is being fitted into the receptacle housing 20.

Here, in this embodiment, the protrusions 112*d* are formed only at peripheral edge portions of the bottom wall 112 but not formed in the inner area of the bottom wall 112.

In this embodiment, the protrusions 112*d* are composed of only a pair of front protrusions 112*f* formed elongate in the width direction at the front ends of both sides in the width direction of the bottom wall 112 and a pair of rear protrusions 112*g* formed elongate in the front-rear direction at the rear ends of both sides in the width direction of the bottom wall 112.

These front protrusions 112*f* and the rear protrusions 112*g* are formed at portions connecting to the side walls 113 of the bottom wall 112. Specifically, the front protrusions 112*f* are formed in front of the holding bracket attachments 113*c* so as to extend along the front end edge of the plug housing 10, and the rear protrusions 112*g* are formed at outer portions in the width direction of the extension parts 113*a* so as to extend along the outer end edges of the extension parts 113*a*. As described above, in this embodiment, the protrusions 112*d* are formed at only the four corners of the bottom wall 112.

Further, in this embodiment, for the shape of the for-connection portion 10A of the cable 1A, part of the outline of the shape corresponds to the outline of the inner area surrounded by the protrusions 112*d*. Specifically, the for-connection portion 10A of the cable 1A is formed such that, in the state where it is housed in the recess part 112*e*, the front end edges of both sides in the width direction where the cut-in portions 1*a*A and 14*a*A are not formed extend along the outlines on the inner sides (rear sides) of the front protrusions 112*f*, and that the rear end portions on both sides in the width direction extend along the outlines of the inner sides in the width direction of the rear protrusions 112*g*. With this configuration, the front protrusions 112*f* prevent the positional deviation of the for-connection portion 10A to the front, and the rear protrusions 112*g* prevent the positional deviation of the for-connection portion 10A in the width direction. Note that the for-connection portion 10A may have any shape as long as it can be housed in the recess part 112*e*.

Then, in the case where the protrusions 112*d* are formed only at the four corners of the bottom wall 112 as in this embodiment, the protrusions 112*d* can be configured so as not to overlap with the first and second mounting pieces 132 and 142 of the plug terminals 13 and 14 when the plug housing 10 holding the plug terminals 13 and 14 lined side-by-side in the width direction (Y direction: one direction) is viewed along the front-rear direction (X direction: intersecting direction).

In this embodiment, the distal ends of the first and second mounting pieces 132 and 142 protrude on the side where the recess part 112*e* is provided (downward of the plug housing 10) in the state where the plug terminals 13 and 14 are held by the plug housing 10.

As described above, in this embodiment, when the plug housing 10 holding the plug terminals 13 and 14 is viewed along the front-rear direction (X direction: intersecting direction), the distal ends of the first and second mounting pieces 132 and 142 of the plug terminals can be seen both from the front side and from the rear side. Note that the distal ends of the first and second mounting pieces 132 and 142 of the plug terminals are apart from one another in the width direction and protrude downward of the plug housing 10 when viewed in the front-rear direction.

Further, in this embodiment, the first and second mounting pieces 132 and 142 are formed in thin plate shapes as described later, and the plate thickness direction of the first and second mounting pieces 132 and 142 approximately agrees with the width direction (Y direction) in the state where the plug terminals 13 and 14 are held by the plug housing 10. In other words, the plurality of plug terminals 13 and 14 are held by the plug housing 10 to be lined side-by-side along the plate thickness direction of the first and second mounting pieces 132 and 142.

The plug terminals 13 and 14 have main body parts (the first main body parts 130 and the second main body parts 140) which are inserted into and held by the plug housing 10, and in this embodiment, the insertion direction of the main body parts 130 and 140 approximately agrees with the front-rear direction (X direction). In other words, the intersecting direction, in which the protrusions 112*d* do not overlap with the first and second mounting pieces 132 and 142 of the plug terminals 13 and 14, agrees with the insertion direction in which the main body parts 130 and 140 are inserted into the plug housing 10.

As described above, in this embodiment, all the first and second mounting pieces 132 and 142 of the plug terminals 13 and 14 which are apart from one another in the width direction and protrude downward of the plug housing 10 do not overlap with the protrusions 112*d* when viewed along the insertion direction of the main body parts 130 and 140 into the plug housing 10.

Next, with reference to FIGS. 15 and 16, description is given of a specific configuration of the plug terminals (terminals).

In this embodiment, the plug terminals each include: a main body part to be inserted into a space formed in the plug housing 10; a leg part extending from the main body part toward the mounting surface 1*a*A of the cable 1A in a state where the plug terminals are mounted on the cable (the mounting member) 1A; and a mounting part provided continuously from the leg part and to be mounted on the cable 1A.

To be more specific, the plug terminals include the lower plug terminal 13 to be press-fitted (inserted) into the first space S1 formed on the lower side (mounting surface 1*a*A side) of the housing main body 11. The plug terminals further include the upper plug terminal 14 to be press-fitted (inserted) into the second space S2 formed on the upper side (position further away from the mounting surface 1*a*A than the first space S1) of the housing main body 11.

In this embodiment, the lower plug terminal 13 is conductive, and a plurality of the lower plug terminals 13 are arranged in the width direction (Y direction) of the plug housing 10. As shown in FIGS. 15A to 15F, the lower plug terminal 13 has a shape formed by bending a strip-shaped metal member in a strip thickness direction, and has an approximately U-shape when viewed along the insertion direction (front-rear direction; X direction) (see FIGS. 15E and 15F). The lower plug terminal 13 as above can be formed, for example, by punching out a strip-shaped metal member having a specified shape and bending it.

The lower plug terminal 13 also includes a first main body part (main body part) 130 to be press-fitted (inserted) into the first space S1. The lower plug terminal 13 further includes: a first leg part (leg part) 131 extending from the first main body part 130 toward the mounting surface 1*a*A in a state where the lower plug terminal 13 is mounted on the cable (the mounting member) 1A; and a first mounting piece (mounting part) 132 connected to the first leg part 131 and to be mounted on the cable 1A.

The first main body part 130 includes a bottom wall 133 and a side wall 134 connected to both ends, in the width direction (Y direction) of the bottom wall 133.

The bottom wall 133 includes: a bottom wall main body 135 provided continuously from the lower end of the side wall 134; and a contact protection part 136 that is provided continuously from the front end of the bottom wall main body 135 and protrudes forward. This contact protection part 136 prevents a contact part 130*a* of the lower plug terminal 13 from coming into contact with the housing main body 11 when the first main body part 130 is press-fitted (inserted) into the first space S1.

The bottom wall main body 135 and the contact protection part 136 have restricting pieces 135*a* and 136*a* formed therein, respectively, which protrude outward from both ends in the width direction (Y direction). These restricting pieces 135*a* and 136*a* prevent the first main body part 130 from being obliquely press-fitted (inserted) when the first main body part 130 is press-fitted (inserted) into the first space S1.

The side wall 134 includes: a side wall main body 137 having its lower end provided continuously from the bottom wall main body 135; and an elastically deformable contact piece 138 that is provided continuously from the front end of the side wall main body 137 and comes into contact with the contact part of the receptacle connector.

The side wall main body 137 has a restricting protrusion 137*a* formed at its upper end. This restricting protrusion 137*a* prevents the first main body part 130 from being lifted when press-fitted (inserted) into the first space S1.

The contact piece 138 includes: an inner bent piece 138*a* provided continuously from the front end of the side wall main body 137 so as to be bent inward in the width direction, and an outer bent piece 138*b* provided continuously from the front end of the inner bent piece 138*a* so as to be bent inward in the width direction.

In this embodiment, the contact pieces 138 are provided continuously from the pair of side wall main bodies 137, 137, respectively, and are formed to be approximately line-symmetric in the plan view. More specifically, the pair of contact pieces 138, 138 include: the inner bent pieces 138*a*, 138*a* bent in a direction of getting close to each other toward the front; and the outer bent pieces 138*b*, 138*b* bent in a direction of getting away from each other toward the front.

The contact part 230*a* of the receptacle connector 2 is sandwiched in a spot (connection between the inner bent piece 138*a* and the outer bent piece 138*b*) where the pair of contact pieces 138, 138 come closest to each other (see FIG. 3B). Thus, in this embodiment, the pair of contact pieces 138, 138 function as the contact part 130*a* of the lower plug terminal 13. Also, the pair of outer bent pieces 138*b* function as a guide part for more smoothly guiding the contact part 230*a* of the receptacle connector 2.

Furthermore, in this embodiment, an extension wall 139 protruding rearward is provided continuously from the rear end of one of the pair of side wall main bodies 137, 137, and the first main body part 130 has a shape having its one side protruding rearward.

This extension wall 139 has a press-fit protrusion 139*a* formed at its upper end. The first main body part 130 is press-fitted into the first space S1 by sticking the press-fit protrusion 139*a* into the housing main body 11.

Note that, in this embodiment, the grooves 115*a* are formed to guide the press-fitting (insertion) of the lower plug terminal 13 into the first space S1 while the upper ends of the side walls 134 of the lower plug terminal 13 are inserted into the grooves. Therefore, a positional shift in the lower plug terminal 13 is suppressed even when the lower plug terminal 13 is press-fitted (inserted) into the first space S by pressing one side wall 134 protruding rearward of the first main body part 130. As a result, the lower plug terminal 13 can be press-fitted (inserted) more smoothly and more accurately into the first space S1.

The first leg part 131 is provided extending downward (toward the cable 1A mounting member) from the rear end of the extension wall 139. Thus, in this embodiment, the first leg part 131 is provided extending in the housing thickness direction from the first main body part 130 that is press-fitted (inserted) into the first space S1. Moreover, a first mounting piece 132 is provided continuously from the lower end of the first leg part 131 so as to protrude forward.

In this event, the first leg part 131 and the first mounting piece 132 are each formed into a thin plate shape (plate shape) such that its plate thickness direction is approximately the same as the thickness direction of the side wall main body 137.

Therefore, in a state where the first main body part 130 is inserted into the first space S1 and also the first mounting piece (mounting part) 132 is mounted on the cable (mounting member) 1A, the thickness direction of the first leg part 131 is the width direction (Y direction). More specifically, in a state where the plug connector 1 is mounted on the cable 1A, the thickness direction of the first leg part 131 is the direction intersecting with the insertion direction of the first main body part 130 into the first space S1 and with the direction normal to the mounting surface 1*a*A.

Meanwhile, the upper plug terminal 14 is also conductive, and a plurality of the upper plug terminals 14 are arranged in the width direction (Y direction) of the plug housing 10. As shown in FIGS. 16A to 16F, the upper plug terminal 14 has a shape formed by bending a strip-shaped metal member in a strip thickness direction, and has an approximately U-shape when viewed along the insertion direction (front-rear direction; X direction) (see FIGS. 16E and 16F). Such an upper plug terminal 14 can also be formed, for example, by bending a strip-shaped metal member.

The upper plug terminal 14 also includes a second main body part (main body part) 140 to be press-fitted (inserted) into the second space S2. The upper plug terminal 14 further includes: a second leg part (leg part) 141 extending from the second main body part 140 toward the mounting surface 1*a*A in a state where the upper plug terminal 14 is mounted on the cable 1A; and a second mounting piece (mounting part) 142 provided continuously from the second leg part 141 and to be mounted on the cable 1A.

The second main body part 140 includes a bottom wall 143 and a side wall 144 provided continuously from both ends, in the width direction (Y direction) of the bottom wall 143.

The bottom wall 143 includes: a bottom wall main body 145 provided continuously to the lower end of the side wall 144; and a contact protection part 146 that is provided continuously from the front end of the bottom wall main body 145 and protrudes forward. This contact protection part 146 prevents a contact part 140*a* of the upper plug terminal 14 from coming into contact with the housing main body 11 when the second main body part 140 is press-fitted (inserted) into the second space S2.

The bottom wall main body 145 and the contact protection part 146 have restricting pieces 145*a* and 146*a* formed therein, respectively, which protrude outward from both ends in the width direction (Y direction). These restricting pieces 145*a* and 146*a* prevent the second main body part 140 from being obliquely press-fitted (inserted) when the second main body part 140 is press-fitted (inserted) into the second space S2.

The side wall 144 includes: a side wall main body 147 having its lower end connected to the bottom wall main body 145; and an elastically deformable contact piece 148 that is provided continuously from the front end of the side wall main body 147 and comes into contact with the contact part 240*a* of the receptacle connector 2.

The side wall main body 147 has a restricting protrusion 147*a* formed at its upper end. This restricting protrusion 147*a* prevents the second main body part 140 from being lifted when press-fitted (inserted) into the second space S2.

The contact piece 148 includes: an inner bent piece 148*a* provided continuously from the front end of the side wall main body 147 so as to be bent inward in the width direction, and an outer bent piece 148*b* provided continuously from the front end of the inner bent piece 148*a* so as to be bent inward in the width direction.

In this embodiment, the contact pieces 148 are continuous from the pair of side wall main bodies 147, 147, respectively, and are formed to be approximately line-symmetric in the plan view. More specifically, the pair of contact pieces 148, 148 include: the inner bent pieces 148*a*, 148*a* bent in a direction of getting close to each other toward the front; and the outer bent pieces 148*b*, 148*b* bent in a direction of getting away from each other toward the front.

Figure 4B:
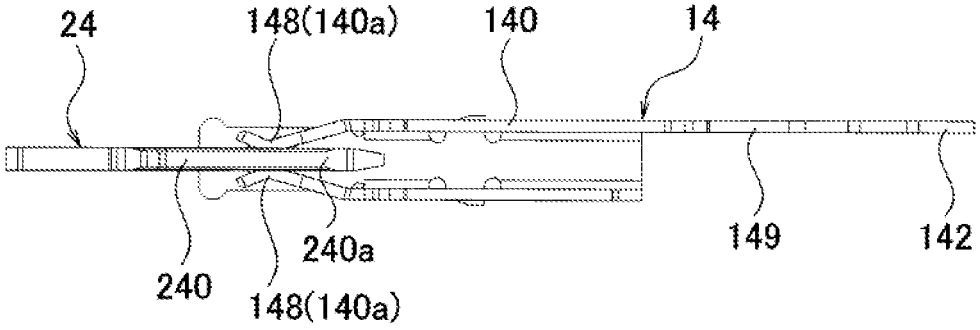

The contact part 240*a* of the receptacle connector 2 is sandwiched in a spot (connection between the inner bent piece 148*a* and the outer bent piece 148*b*) where the pair of contact pieces 148, 148 come closest to each other (see FIG. 4B). Thus, in this embodiment, the pair of contact pieces 148, 148 function as the contact part 140*a* of the upper plug terminal 14. Also, the pair of outer bent pieces 148*b* function as a guide part for more smoothly guiding the contact part 240*a* of the receptacle connector 2.

Furthermore, in this embodiment, an extension wall 149 protruding rearward is provided continuously from the rear end of one of the pair of side wall main bodies 147, 147, and the second main body part 140 has a shape having its one side protruding rearward.

This extension wall 149 has a press-fit protrusion 149*a* formed at its upper end. The second main body part 140 is press-fitted into the second space S2 by sticking the press-fit protrusion 149*a* into the housing main body 11.

Note that, in this embodiment, the grooves 111*a* are formed to guide the press-fitting (insertion) of the upper plug terminal 14 into the second space S2 while the upper ends of the side walls 144 of the upper plug terminal 14 are inserted into the grooves. Therefore, a positional shift in the upper plug terminal 14 is suppressed even when the upper plug terminal 14 is press-fitted (inserted) into the second space S2 by pressing one side wall 144 protruding rearward of the second main body part 140. As a result, the upper plug terminal 14 can be press-fitted (inserted) more smoothly and more accurately into the second space S2.

The second leg part 141 is provided extending downward (toward the cable 1A: mounting member) from the rear end of the extension wall 149. The second leg part 141 has its length, in the top-bottom direction, longer than the first leg part 131. Thus, in this embodiment, the second leg part 141 is provided extending in the housing thickness direction from the second main body part 140 that is press-fitted (inserted) into the second space S2. Moreover, a second mounting piece 142 is provided continuously from the lower end of the second leg part 141 so as to protrude rearward.

As described above, in this embodiment, the first mounting piece (mounting part) 132 is provided continuously from the first leg part 131 so as to protrude forward (toward one side) in the front-rear direction (X direction: insertion direction into the space of the main body part). Also, the second mounting piece (mounting part) 142 is provided continuously from the second leg part 141 so as to protrude rearward (toward the other side) in the front-rear direction (X direction: insertion direction into the space of the main body part).

The first leg part 131 and the second leg part 141 are located at approximately the same position in the front-rear direction in a state where the first main body part 130 and the second main body part 140 are inserted into the first space S1 and the second space S2 (see FIGS. 5 to 7). At the same time, the first leg part 131 and the second leg part 141 are located at positions shifted by approximately a half pitch in the width direction in the state where the first main body part 130 and the second main body part 140 are inserted into the first space S1 and the second space S2.

Therefore, in this embodiment, the mounting parts (first and second mounting pieces 132 and 142) are arranged in a staggered pattern in a state where the plurality of plug terminals 13 and 14 are held by the plug housing 10.

Furthermore, the first mounting piece 132 is housed in the recess part 112*c* formed at the rear end of the bottom wall 112 in the state where the first main body part 130 is inserted into the first space S1. Meanwhile, the second mounting piece 142 is positioned behind the insertion opening S1*a* of the second space S2 in the state where the second main body part 140 is inserted into the second space S2.

Therefore, the first mounting piece 132 overlaps with the plug housing 10 in the plan view in a state where the plurality of plug terminals 13 and 14 are held by the plug housing 10 and also mounted on the cable 1A. At the same time, the second mounting piece 142 is exposed from the plug housing 10 in the plan view in a state where the plurality of plug terminals 13 and 14 are held by the plug housing 10 and also mounted on the cable 1A.

More specifically, either one of the first and second mounting pieces (mounting parts) 132 and 142 overlaps with the plug housing 10 when the plug housing 10 is viewed along the direction normal to the mounting surface 1*a*A in a state where the plug connector 1 is mounted on the cable 1A.

Thus, in this embodiment, the mounting parts (first and second mounting pieces 132 and 142) are arranged in a staggered pattern on either side of the insertion opening (rear end) of the space in the state where the plurality of plug terminals 13 and 14 are held by the plug housing 10.

Moreover, the second leg part 141 and the second mounting piece 142 are also each formed into a thin plate shape (plate shape) such that its plate thickness direction is approximately the same as the thickness direction of the side wall main body 147.

Therefore, in a state where the second main body part 140 is inserted into the second space S2 and also the second mounting piece (mounting part) 142 is mounted on the cable (mounting member) 1A, the thickness direction of the second leg part 141 is the width direction (Y direction). More specifically, in a state where the plug connector 1 is mounted on the cable 1A, the thickness direction of the second leg part 141 is the direction intersecting with the insertion direction of the second main body part 140 into the second space S2 and with the direction normal to the mounting surface 1*a*A.

Moreover, in this embodiment, the first insertion opening S1*a* is divided into two regions by the second leg part 141 when viewed from the rear side in the front-rear direction in a state where the main body parts 130 and 140 of the plug terminals 13 and 14 are inserted into the spaces S1 and S2. More specifically, the first insertion opening S1*a* of the first space S1 is divided into the two regions R1 and R2 by the second leg part 141 when the plug housing is viewed along the insertion direction of the main body parts 130 and 140 into the spaces S1 and S2 in a state where the plug connector 1 is mounted on the cable 1A.

Furthermore, in this embodiment, at the position where the press-fitting (insertion) of the first main body part 130 into the first space S1 is completed, the first leg part 131 is held in a state of being inserted into the groove 112*b* and having its movement restricted in the width direction (Y direction; thickness direction). More specifically, the groove 112*b* formed in the bottom wall 112 of the housing main body 11 functions as a leg part holder to hold the first leg part 131. Thus, the plug connector 1 includes the leg part holder connected to the plug housing 10 to hold the first leg part 131. In this embodiment, the leg part holder is formed integrally with the plug housing 10. Note that the leg part holder may be formed by connecting a separate member from the plug housing 10 to the plug housing 10.

Moreover, at the position where the press-fitting (insertion) of the second main body part 140 into the second space S2 is completed, the second leg part 141 is held in a state of being inserted into the grooves 115*b* and 112*a* and having its movement restricted in the width direction (Y direction; thickness direction). More specifically, the groove 115*b* formed in the partition wall 115 of the housing main body 11 and the groove 112*a* formed in the bottom wall 112 thereof function as a leg part holder to hold the second leg part 141. Thus, the plug connector 1 includes the leg part holder connected to the plug housing 10 to hold the second leg part 141. The leg part holder is also formed integrally with the plug housing 10 in this embodiment, but may be formed as a separate member.

In this way, the first and second leg parts 131 and 141 are prevented from being deformed when the plug terminals 13 and 14 are press-fitted (inserted) into the spaces S1 and S2 of the main body parts 130 and 140, when the plug terminals 13 and 14 press-fitted (inserted) into the spaces S1 and S2 are mounted on the cable 1A, or the like.

Configuration Example of Receptacle Connector 2

Next, with reference to FIGS. 17 to 22, description is given of a configuration example of the receptacle connector 2.

Figure 17:
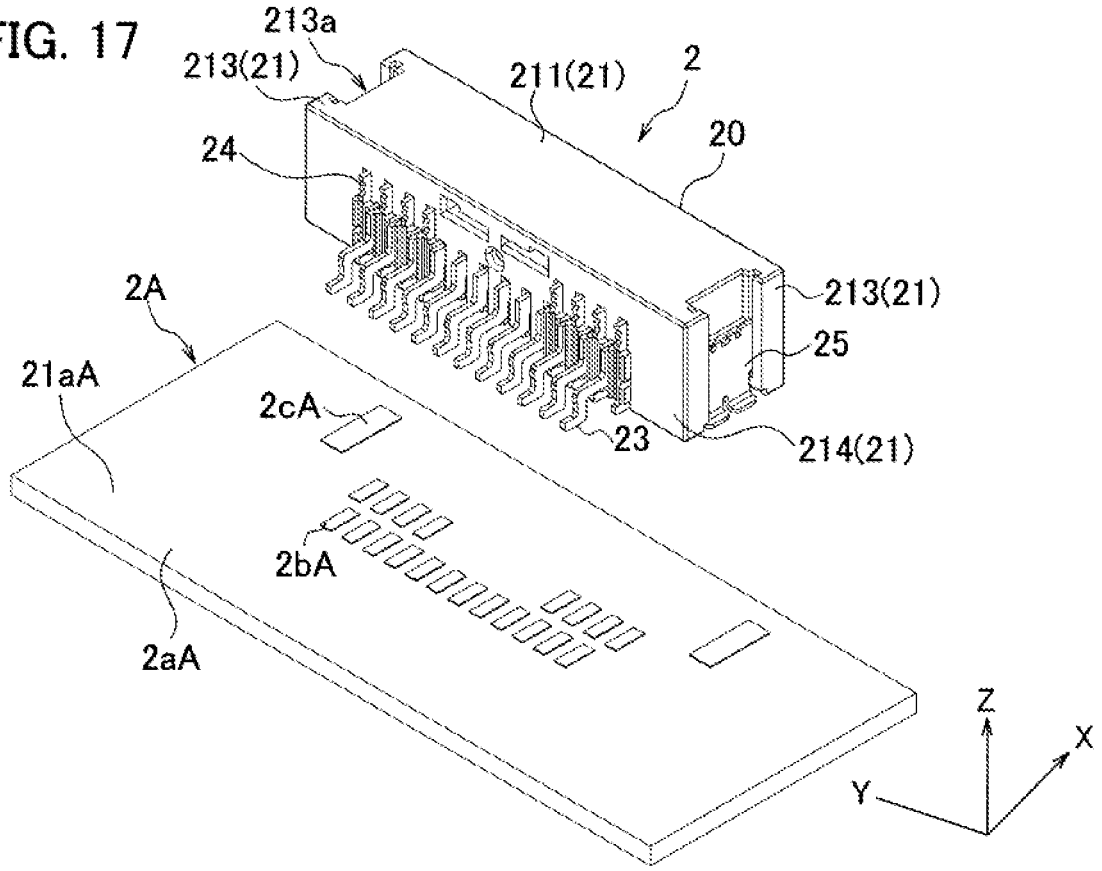
FIG. 17 is a perspective view showing a state before the receptacle connector included in the connector set shown as an example is mounted on the circuit board.
Figure 18:
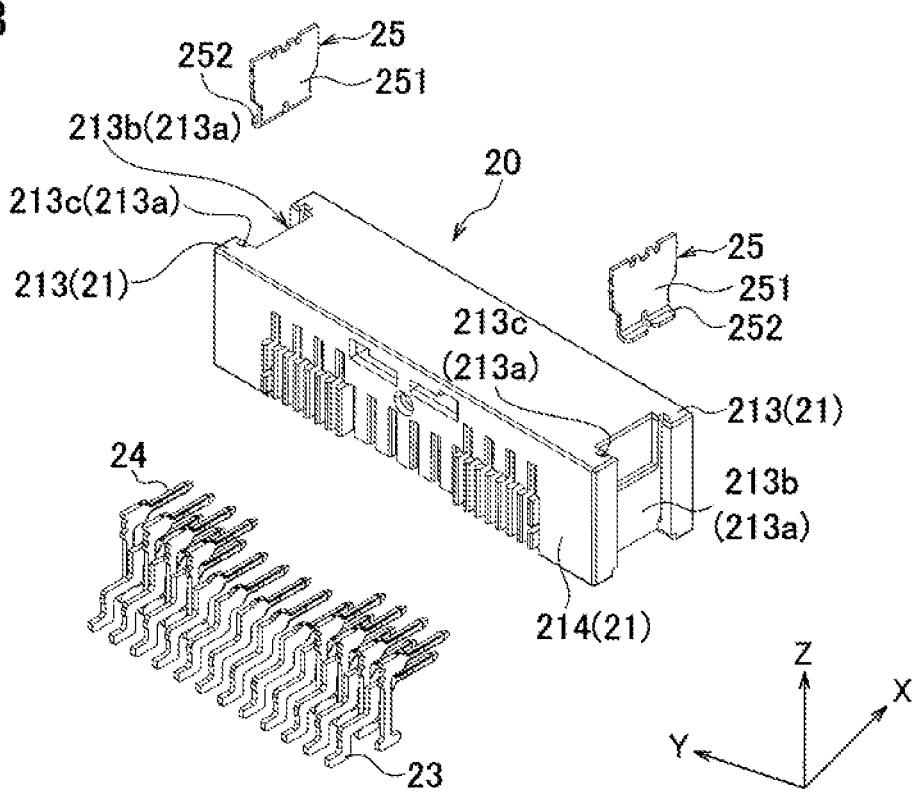
FIG. 18 is an exploded perspective view showing the receptacle connector included in the connector set shown as an example.
Figure 19A:
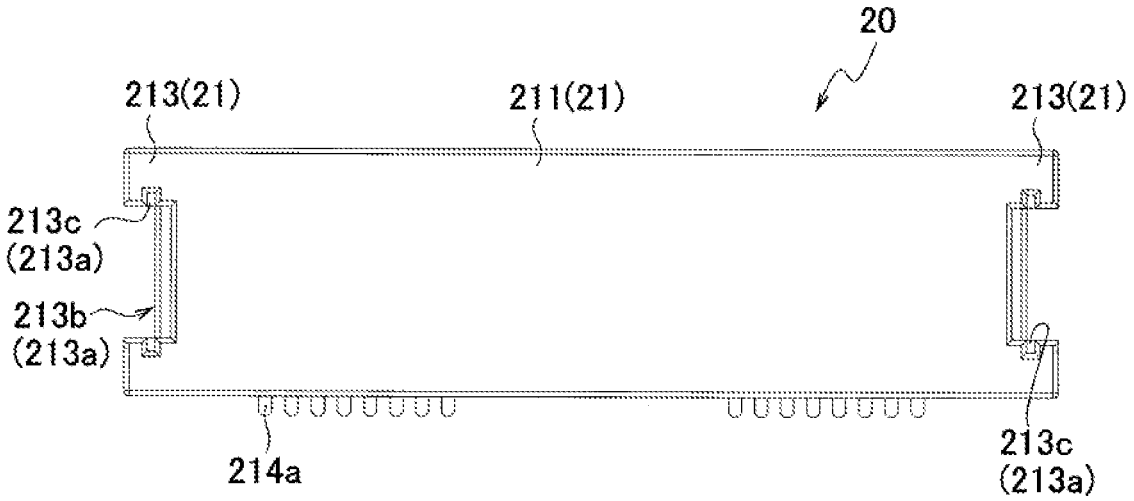
FIG. 19A is a plan view and FIG. 19B is a reverse side view, showing a receptacle housing included in the receptacle connector.
Figure 19B:
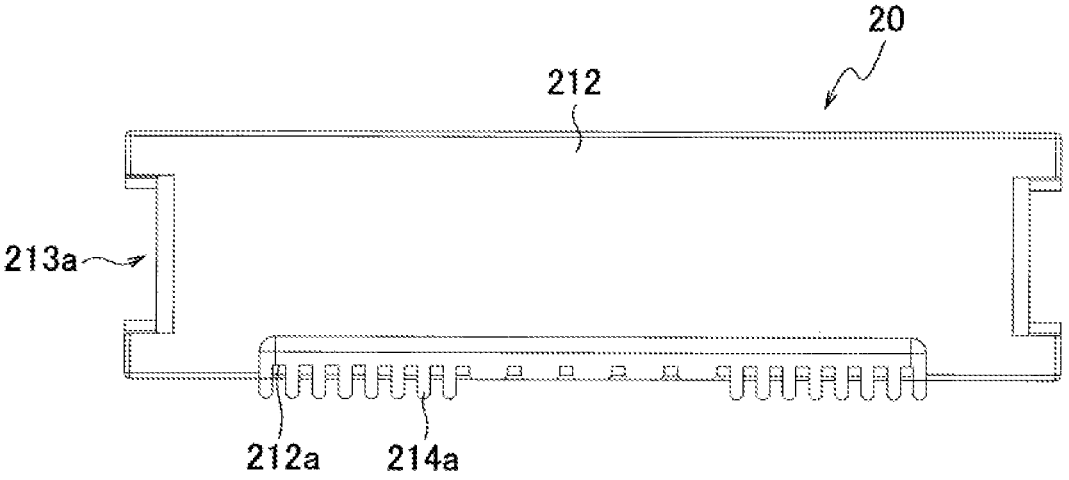
Figure 20A:
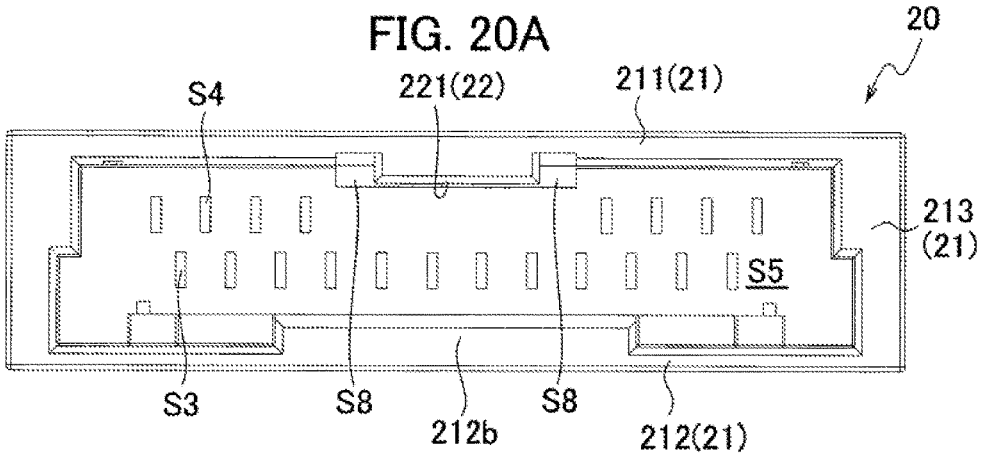
FIG. 20A is a front view.
Figure 20B:
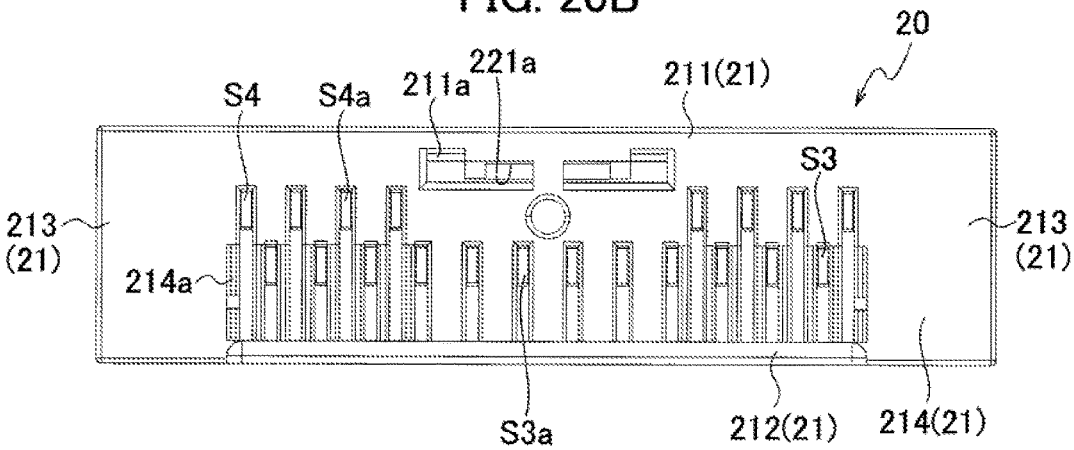
FIG. 20B is a back view.
Figure 20C:
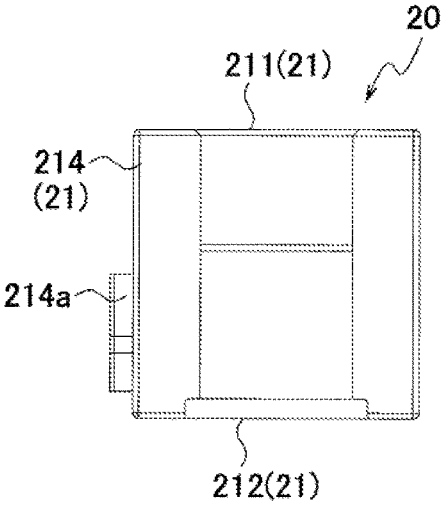
FIG. 20C is a side view.
Figure 20D:
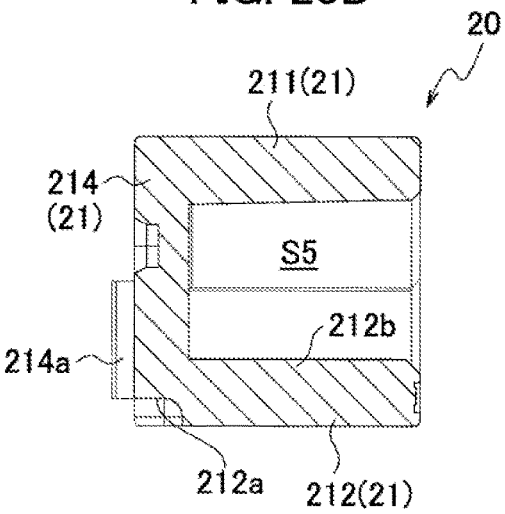
FIG. 20D is a sectional side view, showing the receptacle housing included in the receptacle connector.
Figure 21A:
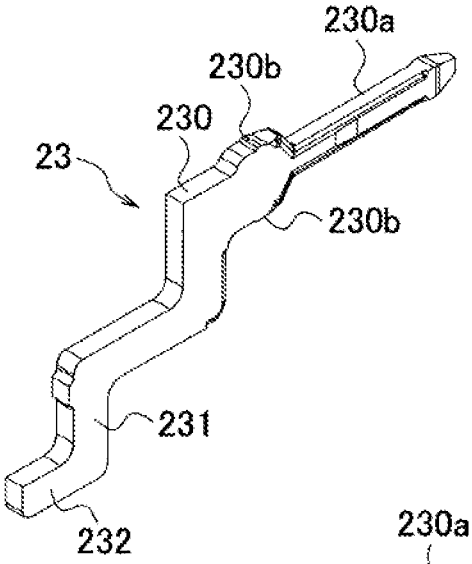
FIG. 21A is a perspective view.
Figure 21E:
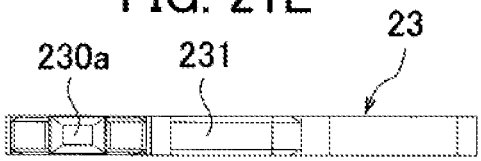
FIG. 21E is a front view.
Figure 21B:
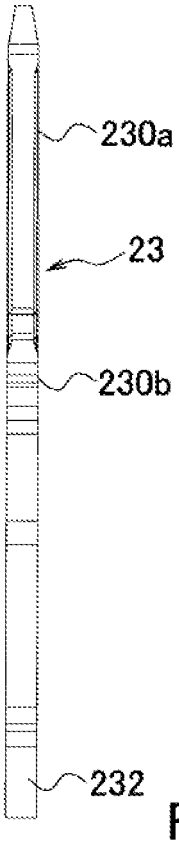
FIG. 21B is a plan view.
Figure 21C:
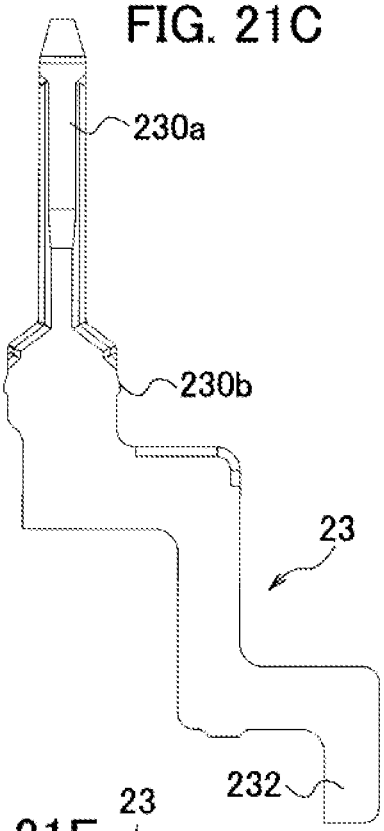
FIG. 21C is a side view.
Figure 21D:
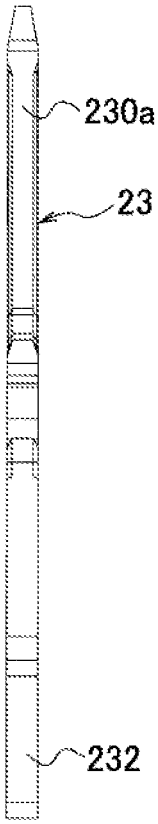
FIG. 21D is a reverse side view.
Figure 21F:
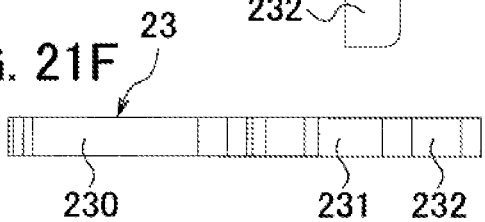
FIG. 21F is a back view, showing a lower receptacle terminal included in the receptacle connector.
Figure 22A:
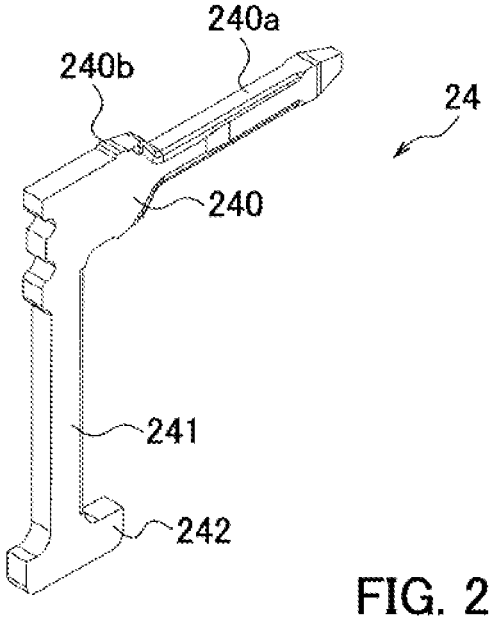
FIG. 22A is a perspective view.
Figure 22B:
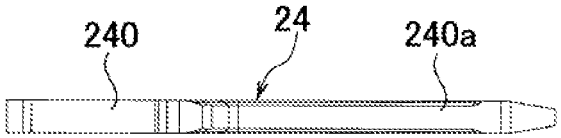
FIG. 22B is a plan view.
Figure 22F:
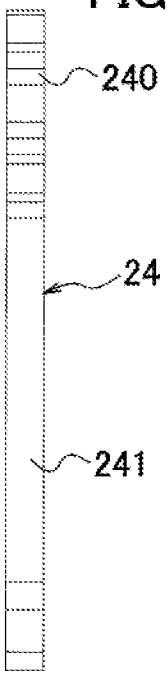
FIG. 22F is a back view, showing an upper receptacle terminal included in the receptacle connector.
Figure 22C:
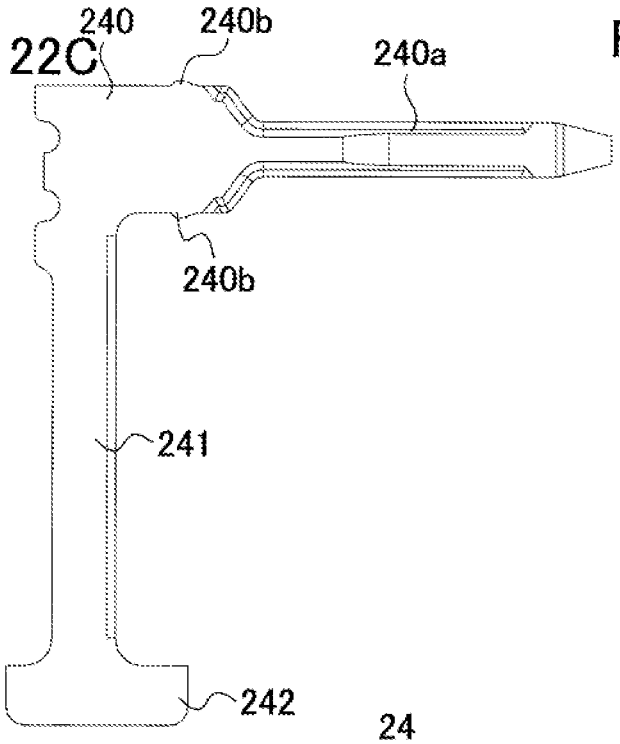
FIG. 22C is a side view.
Figure 22E:
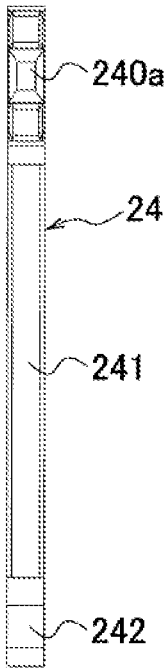
FIG. 22E is a front view.
Figure 22D:
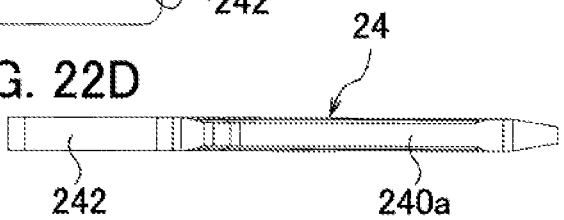
FIG. 22D is a reverse side view.

As shown in FIGS. 17 and 18, the receptacle connector 2 includes a receptacle housing (opponent housing) 20 and receptacle terminals (opponent terminals: lower receptacle terminals 23 and upper receptacle terminals 24) held by the receptacle housing 20. The receptacle connector 2 also includes holding brackets (opponent holding brackets) 25 held by the receptacle housing 20.

The receptacle connector 2 is configured to be mounted on the circuit board 2A as the opponent mounting member by mounting the receptacle terminals 23 and 24 held by the receptacle housing 20 on the conductor part 2*b*A of the circuit board 2A disposed outside the receptacle housing 20. Note that the receptacle terminals 23 and 24 are also mounted on the conductor part 2*b*A by soldering or the like. The holding brackets 25 are fixed to the fixing parts 2*c*A of the circuit board 2A by soldering or the like, in a state where the holding brackets 25 are held by the receptacle housing 20, to fix the receptacle housing 20 to the circuit board 2A.

Note that the circuit board 2A includes a board main body 2*a*A that has an approximately rectangular plate shape and is formed of a rigid and insulating resin material or the like. The conductor part 2*b*A and the fixing parts 2*c*A are formed so as to be exposed to the surface 21*a*A of the board main body 2*a*A. Thus, in this embodiment, the surface 21*a*A of the board main body 2*a*A serves as a mounting surface.

The receptacle housing 20 includes a rigid housing main body 21, and can be formed, for example, using an insulating resin material.

The housing main body 21 also has a lock insertion part 22 formed on its upper side. The lock part 12 configured to hold the plug housing 10 and the receptacle housing 20 in their fitted state or to release the fitted state is inserted into this lock insertion part 22.

Thus, in this embodiment, the receptacle housing 20 includes the housing main body 21 and the lock insertion part 22 formed in the housing main body 21.

The housing main body 21 includes a top wall 211, a bottom wall 212, a pair of side walls 213 connecting both ends, in the width direction (Y direction), of the top wall 211 and the bottom wall 212, and a rear wall 214 provided continuously from rear ends of the top wall 211, the bottom wall 212, and the side walls 213, 213.

The lock insertion part 22 is formed in the middle, in the width direction, of the top wall 211. To be more specific, the lock insertion part 22 includes a housing part 221 that is formed inside of the top wall 211, and houses the lever part 121. In the middle, in the front-rear direction, of the housing part 221, an engagement recess part (engaged part) 221*a* is formed to engage with the engagement protrusion 121*b* of the lock part 12.

In addition, on either side, in the width direction, of the housing part 221, insertion spaces S8 into which the upper arm parts 33 of the slide member 3 are inserted are formed. On the top wall 211, protrusions (locked part) 211*a* protruding downward are formed such that the protrusions (locked part) 211*a* are located in the insertion spaces S8 as viewed in an insertion direction (front-rear direction; X direction). These protrusions 211*a* are configured to deflect the upper arm parts 33 downward and to lock engagement protrusions 32*b* formed on the tip of the upper arm parts 33.

In addition, on the middle, in the width direction, of the bottom wall 212, a positioning protrusion 212*b* protruding upward is formed. The shape of this positioning protrusion 212*b* corresponds to the shape of the cut-in portion 11*a*A and the cut-in portion 14*a*A. When the plug housing 10 is fitted into the receptacle housing 20, the positioning protrusion 212*b* is inserted into the cut-in portion 11*a*A and the cut-in portion 14*a*A, so that the positioning protrusion 212*b* positions the cable 1A in the width direction.

Moreover, the rear wall 214 has a plurality of spaces formed therein, which penetrate in the front-rear direction. In this embodiment, a plurality of spaces arranged in the width direction (Y direction) are formed in two stages in the top-bottom direction (Z direction). These spaces are formed in a staggered pattern when viewed from the rear side in the front-rear direction of the housing main body 21. Accordingly, the receptacle connector 2 is reduced in size in the width direction.

Then, the lower receptacle terminals 23 and the upper receptacle terminals 24 are press-fitted (inserted) into the spaces penetrating in the front-rear direction, respectively.

To be more specific, the spaces formed on the lower side (mounting surface 21*a*A side) of the housing main body 21 serve as first spaces S3 into which lower receptacle terminals 23 are press-fitted (inserted).

On the other hand, the spaces formed on the upper side (position further away from the mounting surface 21*a*A than the first spaces S3) of the housing main body 21 serve as second spaces S4 into which upper receptacle terminals 24 are press-fitted (inserted).

The lower receptacle terminals 23 are each configured to be press-fitted (inserted) forward from an opening at the rear end side of the first space S3. This opening at the rear end side of the first space S3 serves as an insertion opening (insertion slot) S3*a*. Likewise, the upper receptacle terminals 24 are each configured to be press-fitted (inserted) forward from an opening at the rear end side of the second space S4. This opening at the rear end side of the second space S4 serves as an insertion opening (insertion slot) S4*a*.

Moreover, the housing main body 21 has a fitting space S5 formed therein, which is opened forward (toward the plug connector 1 side). This fitting space S5 is a space into which the housing main body 11 of the plug housing 10 is inserted and fitted, and which is defined by the top wall 211, the bottom wall 212, the pair of side walls 213, 213, and the rear wall 214. Therefore, the first space S3 and the second space S4 are formed to communicate with the fitting space S5, respectively.

Furthermore, in this embodiment, a plurality of projections 214*a* extending in the top-bottom direction and protruding rearward are arranged in the width direction at the rear end of the rear wall 214. To be more specific, the projections 214*a* are formed between the first and second spaces S3 and S4 adjacent to each other in the width direction.

Moreover, a recess part 212*a* that is opened downward and rearward and extends in the front-rear direction is formed at the rear end of the bottom wall 212. This recess part 212*a* houses a mounting piece (opponent mounting part) 242 of the upper receptacle terminal 24 in the press-fitted (inserted) state.

Moreover, the pair of side walls 213, 213 have holding bracket attachments 213*a*, 213*a* formed thereon, respectively, to hold the holding brackets 25.

In this embodiment, the holding bracket attachment 213*a* includes: a recess part 213*b* opened outward in the top-bottom direction and in the width direction; and slits 213*c*, 213*c* provided continuously inward, in the width direction, of the recess part 213*b*, into which both ends, in the front-rear direction, of a main body part 251 of the holding bracket 25 is inserted. In a state where the holding brackets 25 are held by the receptacle housing 20, fixing pieces 252 provided continuously from lower ends of the main body parts 251 are fixed to the fixing parts 2*c*A of the circuit board 2A, thereby fixing the receptacle housing 20 to the circuit board 2A.

Moreover, in this embodiment, the receptacle terminals each include: a main body part to be inserted into a space formed in the receptacle housing 20; a leg part extending from the main body part toward the mounting surface 21*a*A of the circuit board 2A in a state where the receptacle terminals are mounted on the circuit board (the mounting member) 2A; and a mounting part provided continuously from the leg part and to be mounted on the circuit board 2A.

To be more specific, the receptacle terminals include the lower receptacle terminal 23 to be press-fitted (inserted) into the first space S3 formed on the lower side (mounting surface 21*a*A side) of the housing main body 21. The receptacle terminals further include the upper receptacle terminal 24 to be press-fitted (inserted) into the second space S4 formed on the upper side (position further away from the mounting surface 21*a*A than the first space S3) of the housing main body 21.

In this embodiment, the lower receptacle terminal 23 is conductive, and a plurality of the lower receptacle terminals 23 are arranged in the width direction (Y direction) of the receptacle housing 20. As shown in FIG. 21, the lower receptacle terminal 23 is formed into a thin plate shape, and is press-fitted (inserted) from the rear side into the first space S3 formed in the housing main body 21 in a state where the plate thickness direction is approximately aligned with the width direction (Y direction). Such a lower receptacle terminal 23 can be formed, for example, by punching thin sheet metal.

The lower receptacle terminal 23 also includes a first main body part (opponent main body part) 230 to be press-fitted (inserted) into the first space S3. The lower receptacle terminal 23 further includes: a first leg part (opponent leg part) 231 extending from the first main body part 230 toward the mounting surface 21*a*A in a state where the lower receptacle terminal 23 is mounted on the circuit board (the mounting member) 2A: and a first mounting piece (opponent mounting part) 232 provided continuously from the first leg part 231 and to be mounted on the circuit board 2A.

At the front end of the first main body part 230, an approximately rod-shaped contact part (opponent contact part) 230*a* is formed so as to protrude forward. Also, press-fit protrusions 230*b* are formed at the upper and lower ends of the first main body part 230. The first main body part 230 is press-fitted into the first space S3 by sticking the press-fit protrusions 230*b* into the housing main body 21. In the state where the first main body part 230 is press-fitted (inserted) into the first space S3, the contact part 230*a* is disposed in the fitting space S5.

Moreover, in this embodiment, the first leg part 231 is provided extending downward (toward the circuit board 2A: mounting member) from the rear end of the first main body part 230. To be more specific, the first leg part 231 is bent into a crank shape and has its lower end located behind the first main body part 230. Thus, in this embodiment, the first leg part 231 is provided extending in the housing thickness direction (top-bottom direction) from the first main body part 230 press-fitted (inserted) into the first space S3. The first mounting piece 232 is provided continuously from the lower end of this first leg part 231 so as to protrude rearward.

Meanwhile, the upper receptacle terminal 24 is also conductive, and a plurality of the upper receptacle terminals 24 are arranged in the width direction (Y direction) of the receptacle housing 20. As shown in FIG. 22, the upper receptacle terminal 24 is formed into a thin plate shape, and is press-fitted (inserted) from the rear side into the second space S4 formed in the housing main body 21 in a state where the plate thickness direction is approximately aligned with the width direction (Y direction). Such an upper receptacle terminal 24 can also be formed, for example, by punching thin sheet metal.

The upper receptacle terminal 24 also includes a second main body part (opponent main body part) 240 to be press-fitted (inserted) into the second space S4. The upper receptacle terminal 24 further includes: a second leg part (opponent leg part) 241 extending from the second main body part 240 toward the mounting surface 21*a*A in a state where the upper receptacle terminal 24 is mounted on the circuit board (the mounting member) 2A; and a second mounting piece (opponent mounting part) 242 provided continuously from the second leg part 241 and to be mounted on the circuit board 2A.

At the front end of the second main body part 240, an approximately rod-shaped contact part (opponent contact part) 240*a* is formed so as to protrude forward. Also, press-fit protrusions 240*b* are formed at the upper and lower ends of the second main body part 240. The second main body part 240 is press-fitted into the second space S4 by sticking the press-fit protrusions 240*b* into the housing main body 21. In the state where the second main body part 240 is press-fitted (inserted) into the second space S4, the contact part 240*a* is disposed in the fitting space S5.

Moreover, in this embodiment, the second leg part 241 is provided approximately linearly extending downward (toward the circuit board 2A: mounting member) from the rear end of the second main body part 240. Thus, in this embodiment, the second leg part 241 is provided extending in the housing thickness direction (top-bottom direction) from the second main body part 240 press-fitted (inserted) into the second space S4. The second leg part 241 has its length, in the top-bottom direction, longer than the first leg part 231. The first mounting piece 232 is provided continuously from the lower end of this second leg part 241 so as to protrude forward.

Thus, in this embodiment, the second mounting piece (mounting part) 242 is provided continuously from the second leg part 241 so as to protrude forward (toward one side) in the front-rear direction (X direction: insertion direction into the space of the main body part). Also, the first mounting piece (first mounting part) 232 is provided continuously from the first leg part 231 so as to protrude rearward (toward the other side) in the front-rear direction (X direction: insertion direction into the space of the main body part).

More specifically, the mounting parts (first and second mounting pieces 232 and 242) are arranged in a staggered pattern in a state where the plurality of receptacle terminals are held by the receptacle housing 20.

Furthermore, the second mounting piece 242 is housed in the recess part 212*a* formed at the rear end of the bottom wall 212 in the state where the second main body part 240 is inserted into the second space S4. Meanwhile, the first mounting piece 232 is positioned behind the insertion opening S3*a* of the first space S3 in the state where the first main body part 230 is inserted into the first space S3.

Therefore, the second mounting piece 242 overlaps with the receptacle housing 20 in the plan view in a state where the plurality of receptacle terminals 23 and 24 are held by the receptacle housing 20 and also mounted on the circuit board 2A. At the same time, the first mounting pieces 232 are exposed from the receptacle housing 20 in the plan view in a state where the plurality of receptacle terminals 23 and 24 are held by the receptacle housing 20 and also mounted on the circuit board 2A.

More specifically, either one of the first and second mounting pieces (mounting parts) 232 and 242 overlaps with the receptacle housing 20 when the receptacle housing 20 is viewed along the direction normal to the mounting surface 21*a*A in a state where the receptacle connector 2 is mounted on the circuit board 2A.

Thus, in this embodiment, the mounting parts (first and second mounting pieces 232 and 242) are arranged in a staggered pattern on either side of the insertion opening (rear end) of the space in the state where the plurality of receptacle terminals 23 and 24 are held by the receptacle housing 20.

Furthermore, in this embodiment, at the position where the press-fitting (insertion) of the first main body part 230 into the first space S3 is completed, the first leg part 231 is held between the projections 214*a* in a state of having its movement restricted in the width direction (Y direction: thickness direction). More specifically, the projections 214*a* formed on the rear wall 214 of the housing main body 21 function as leg part holders to hold the first leg part 231. Thus, the receptacle connector 2 includes the leg part holders connected to the receptacle housing 20 to hold the first leg part 231. In this embodiment, the leg part holders are formed integrally with the receptacle housing 20. Note that the leg part holders may be formed by connecting separate members from the receptacle housing 20 to the receptacle housing 20.

Moreover, at the position where the press-fitting (insertion) of the second main body part 240 into the second space S4 is completed, the second leg part 241 is held between the projections 214*a* in a state of having its movement restricted in the width direction (Y direction; thickness direction). More specifically, the projections 214*a* formed on the rear wall 214 of the housing main body 21 function as leg part holders 217 to hold the second leg part 241. Thus, the receptacle connector 2 includes the leg part holders connected to the receptacle housing 20 to hold the second leg part 241. The leg part holders are also formed integrally with the receptacle housing 20 in this embodiment, but may be formed as separate members.

In this way, the leg parts 231 and 241 are prevented from being deformed when the receptacle terminals 23 and 24 are press-fitted (inserted) into the spaces S3 and S4 of the main body parts 230 and 240.

When the plug connector 1 described above is fitted into the receptacle connector 2 thus configured, the lock part 12 of the plug housing 10 is inserted into the lock insertion part 22 of the receptacle housing 20, and thus the housing main body 11 is inserted into the fitting space S5.

In this event, the engagement protrusion 121*b* of the lever part 121 is pushed downward by the top wall 211 of the receptacle housing 20. When the engagement protrusion 121*b* is pushed downward by the top wall 211 in this way, the rear end part (operation part 121*a*) of the lever part 121 is elastically deformed so as to move downward, and thus the engagement protrusion 121*b* can be moved into the inner side of the lock insertion part 22.

Then, when the engagement protrusion 121*b* is moved into the inner side of the lock insertion part 22, the downward pushing of the engagement protrusion 121*b* by the top wall 211 is released, and the elastic restoring force of the lever part 121 moves the engagement protrusion 121*b* upward. The engagement protrusion 121*b* is moved upward to be engaged with the engagement recess part 221*a* formed in the receptacle connector 2, thus allowing the plug connector 1 and the receptacle connector 2 to be locked in the fitted state.

During the course of fitting the plug connector 1 into the receptacle connector 2, the tip of the contact part 230*a* of the lower receptacle terminal 23 is introduced into the first space S1 formed in the plug housing 10 from the introduction port S1*b* to come into contact with the contact part 130*a* of the first plug terminal 13. Note that, in this embodiment, the approximately rod-shaped contact part 230*a* is inserted between the pair of contact pieces 138, 138 and sandwiched by the pair of contact pieces 138, 138 to achieve conduction between the first plug terminal 13 and the lower receptacle terminal 23.

Likewise, the tip of the contact part 240*a* of the upper receptacle terminal 24 is introduced into the second space S2 formed in the plug housing 10 from the introduction port S2*b* to come into contact with the contact part 140*a* of the upper plug terminal 14. Note that, in this embodiment, the approximately rod-shaped contact part 240*a* is inserted between the pair of contact pieces 148, 148 and sandwiched by the pair of contact pieces 148, 148 to achieve conduction between the upper plug terminal 14 and the upper receptacle terminal 24.

As described above, the plug connector 1 and the receptacle connector 2 are fitted together to achieve conduction between the plug terminals 13 and 14 and the receptacle terminals 23 and 24. Thus, the connector set C1 is formed to electrically connect the cable 1A to the circuit board 2A.

Meanwhile, in order to detach the plug connector 1 from the receptacle connector 2, the operation part 121*a* of the lever part 121 is first lowered to move the lever part 121 downward. Accordingly, the engagement protrusion 121*b* is also moved downward to release the engagement between the engagement protrusion 121*b* and the engagement recess part 221*a*. Then, by pulling the plug connector 1 in a removal direction from the receptacle connector 2 in the state where the engagement between the engagement protrusion 121*b* and the engagement recess part 221*a* is released, the plug connector 1 is moved in the removal direction relative to the receptacle connector 2. When the plug connector 1 is thus moved in the removal direction relative to the receptacle connector 2, the conduction between the terminals is first released, and then the fitting between the housings is released. Thus, the plug connector 1 is detached from the receptacle connector 2.

Configuration Example of Slide Member 3

Figure 23A:
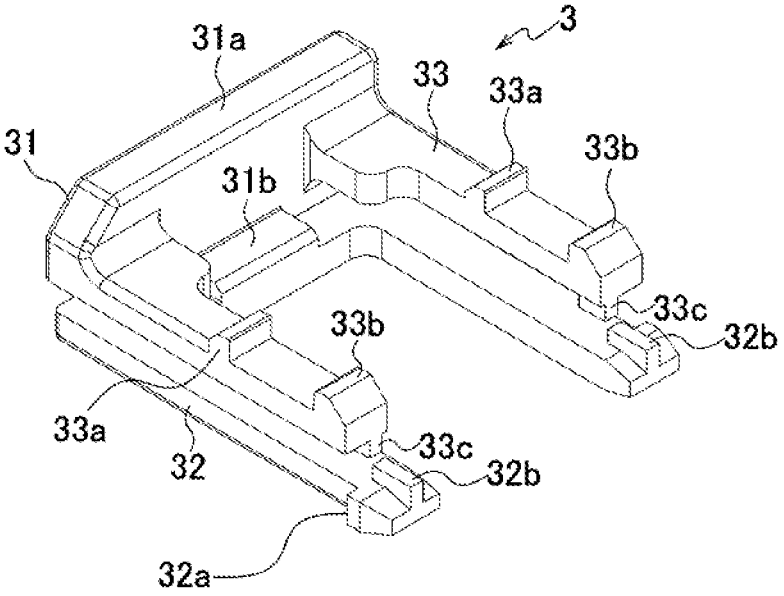
FIGS. 23A and 23B are perspective views showing the slide member included in the connector set shown as an example, FIG. 23A showing a state viewed from one side and FIG. 23B showing a state viewed from the other side.
Figure 23B:
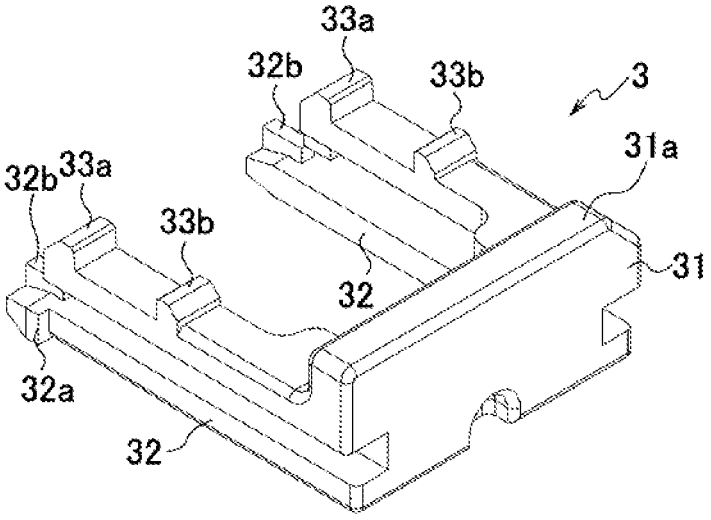
Figure 24A:
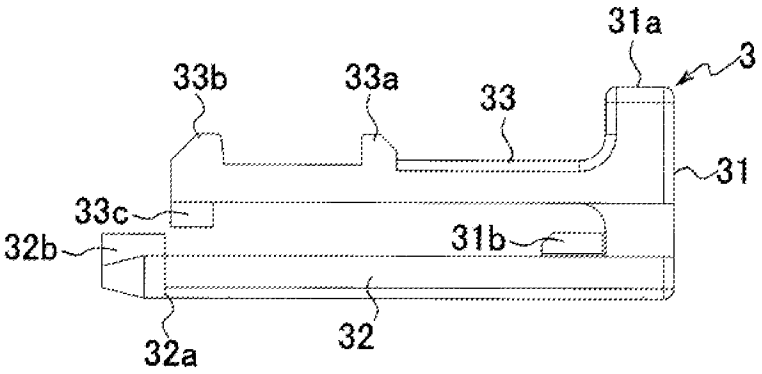
FIG. 24A is a side view.
Figure 24B:
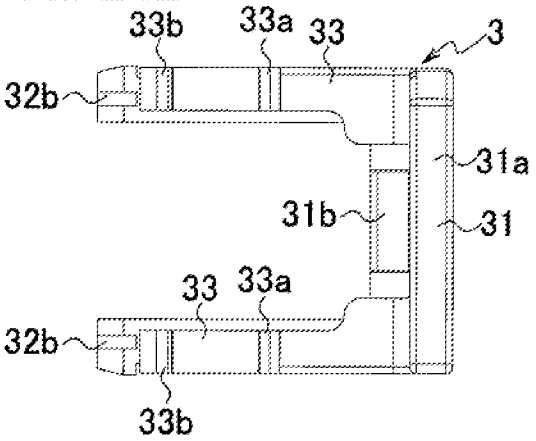
FIG. 24B is a plan view.
Figure 24C:
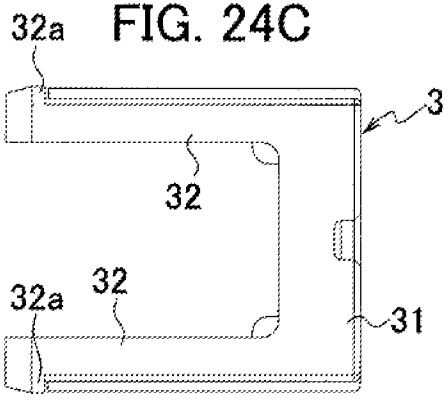
FIG. 24C is a reverse side view.
Figure 24D:
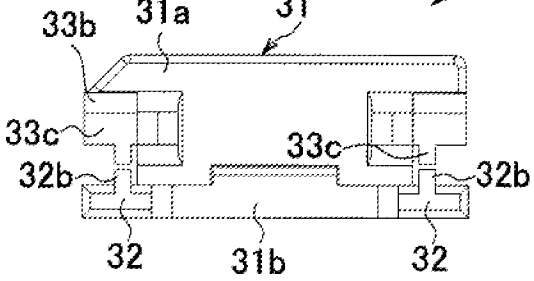
FIG. 24D is a front view.
Figure 24E:
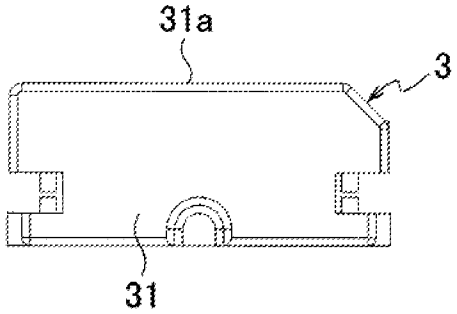
FIG. 24E is a back view, showing the slide member included in the connector set shown as an example.

Next, an example of the configuration of the slide member 3 is described based on FIGS. 23 and 24.

The slide member 3 includes a main body part 31 having a substantially rectangular plate shape. On the upper part of this main body part 31, a handle 31*a* is formed.

In addition, a pair of lower arm parts 32 are provided continuously on either side, in the width direction, of the lower part of the main body part 31 such that the pair of lower arm parts 32 extend forward in the front-rear direction. The pair of lower arm parts 32 are provided continuously on the main body part 31 in a cantilever fashion and are formed to be capable of elastically deforming in the width direction. On the tips (front ends) of these lower arm parts 32, locking protrusions (retaining part) 32*a* are formed to protrude outward in the width direction.

On the other hand, a pair of upper arm part 33 are provided continuously on either side, in the width direction, of the upper part of the main body part 31 such that the pair of upper arm part 33 extend forward in the front-rear direction. The pair of upper arm part 33 are provided continuously on the main body part 31 in a cantilever fashion and formed to be elastically deformed in the top-bottom direction (the direction intersecting the insertion direction of the terminals). In this embodiment, the pair of upper arm parts 33 are formed to be wider on their base sides (the side continuous to the main body part 31). Then, on the tips (front ends) of these upper arm parts 33, engagement protrusions (engaging parts) 33*b* are formed to protrude upward.

In addition, protrusions 33*a* protruding upward are formed in a substantially middle, in the front-rear direction, of the upper arm parts 33.

In a middle, in the width direction, of the lower part of the main body part 31, a restrictive protrusion (restrictor) 31*b* extending forward and upward is formed.

Moreover, in this embodiment, protrusions 32*b* protruding upward are formed on the tips (front ends) of the lower arm parts 32, so that the thickness of the tips of the lower arm parts 32 in the top-bottom direction is larger than the gap (the maximum distance in the top-bottom direction) between the lower arm parts 32 and the upper arm parts 33. To be more specific, the slide member 3 has the protrusions 32*b* formed on the tips of the lower arm parts 32. Then, the thickness of the lower arm parts 32 in the portion where the protrusions 32*b* are formed is made larger than the gap (the maximum distance in the top-bottom direction) between the lower arm parts 32 and the upper arm parts 33. In addition, protrusions 33*c* protruding downward are formed on the tips (front ends) of the upper arm parts 33, so that the thickness of the tips of the upper arm parts 33 in the top-bottom direction is larger than the gap (the maximum distance in the top-bottom direction) between the lower arm parts 32 and the upper arm parts 33. To be more specific, the slide member 3 has the protrusions 33*c* formed on the tips of the upper arm parts 33. Then, the thickness of the upper arm parts 33 in the portion where the protrusions 33*c* are formed is made larger than the gap (the maximum distance in the top-bottom direction) between the lower arm parts 32 and the upper arm parts 33. In this case, the lower arm parts 32 are formed such that the tips of the lower arm parts 32 protrude forward beyond the tips of the upper arm parts 33. This prevents the protrusions 33*c* and the protrusions 32*b* from interfering with each other when the upper arm parts 33 are elastically deformed in the top-bottom direction.

Moreover, the width on the tip side of the lower arm parts 32 protruding forward is also made larger than the gap (the maximum distance in the top-bottom direction) between the lower arm parts 32 and the upper arm parts 33.

This makes it possible to prevent the lower arm parts 32 or the upper arm parts 33 of another slide member 3 from being inserted into the gap between the lower arm parts 32 and the upper arm parts 33 of the slide member 3, so that these arm parts are not entangled with each other. In this way, the slide member 3 according to this embodiment is configured such that the arm parts are prevented from being entangled with each other without hindering the elastic deformation of the upper arm parts 33 in the top-bottom direction.

Next, an example of the operations of the slide member 3 is described based on FIGS. 25 to 28.

As described above, in this embodiment, this slide member 3 functions as the CPA member. Specifically, the slide member 3 is slidably attached to the plug housing 10 such that the slide movement of the slide member 3 from the initial position (first position) to the slide completion position (second position) is restricted in a state where the plug housing 10 has not been completely fitted into the receptacle housing 20 yet. Then, the slide member 3 is configured such that once the plug housing 10 is completely fitted into the receptacle housing 20, the slide movement of the slide member 3 from the initial position to the slide completion position is allowed.

To be more specific, the slide member 3 is configured such that the tips of the lower arm parts 32 are inserted into the insertion space S6 while being deflected inward in the width direction. At this time, the tips of the upper arm parts 33 are also inserted into the insertion space S6.

In a state where the tips of the lower arm parts 32 and the upper arm part 33 are inserted into the insertion space S6, when the slide member 3 is moved forward (inserted) by a predetermined distance, the tips of the lower arm parts 32 move forward beyond the step parts 116*b* formed on the upper partition walls 116, which define the recess part 11*a*. Once the tips of the lower arm parts 32 move forward beyond the step parts 116*b*, the lower arm parts 32 are moved by elastic restoring force in directions to separate from each other (outward in the width direction), so that the locking protrusions 32*a* of the lower arm parts 32 are locked to the step parts 116*b*. As a result, the slide member 3 is slidably held (temporarily held) in the plug housing 10 while being prevented from falling off the housing main body 11 (see FIG. 25).

Figure 26:
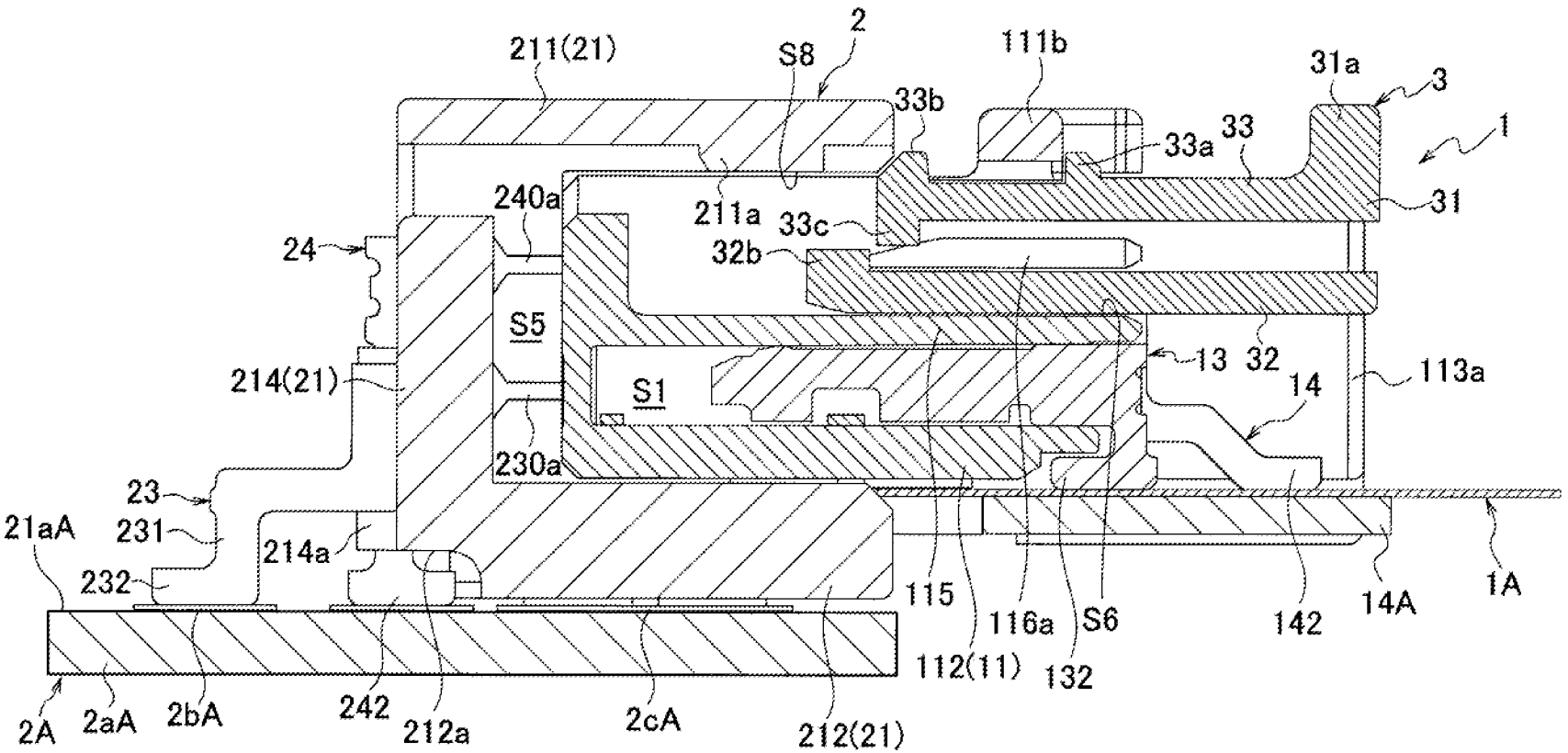
FIG. 26 is a sectional side view explaining how the plug connector and the receptacle connector shown as an example are locked with the slide member and showing a state before the plug connector in which the slide member has been temporarily held is fitted to the receptacle connector.
Figure 27:
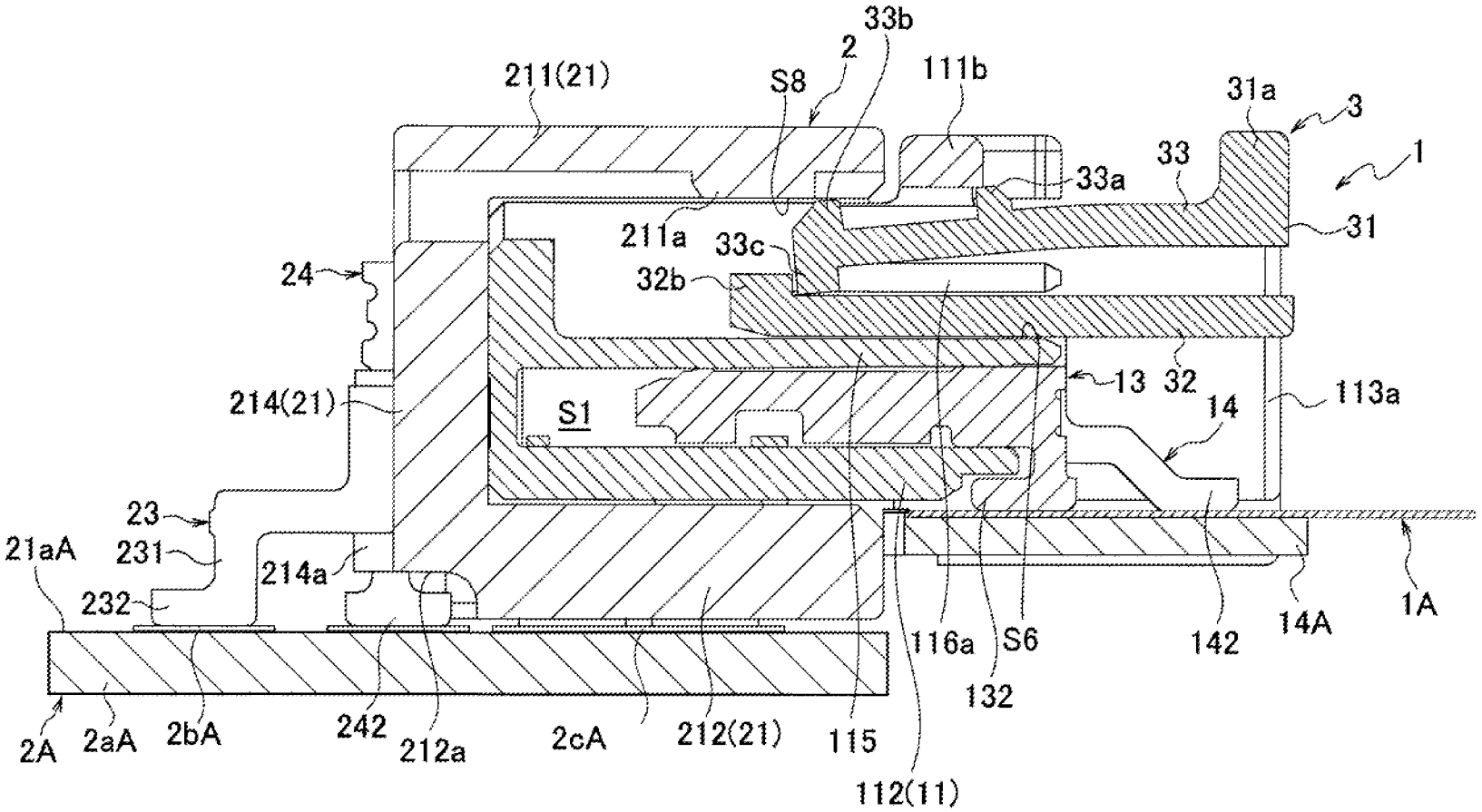
FIG. 27 is a sectional side view explaining how the plug connector and the receptacle connector shown as an example are locked with the slide member and showing a state where the plug connector in which the slide member has been temporarily held has been fitted to the receptacle connector.

Note that in a state where the locking protrusions 32*a* of the lower arm parts 32 are locked to the step parts 116*b*, the protrusions 33*a* of the upper arm parts 33 are located to face the restrictive protrusions (slide restrictor) 111*b* behind the restrictive protrusions (slide restrictors) 111*b* (see FIG. 26).

For this reason, in a state where the slide member 3 is temporarily held in the plug housing 10 not fitted into the receptacle housing 20, if the slide member 3 is attempted to be slid forward, the protrusions 33*a* of the upper arm parts 33 come into contact with the restrictive protrusions 111*b*, thus preventing the slide member 3 from moving forward further.

In this embodiment, this configuration makes it unable for the slide member 3 to slide from the initial position to the slide completion position when the plug housing 10 has not been completely fitted into the receptacle housing 20 yet. Note that in this embodiment, the slide member 3 is regarded as being at the initial position when the locking protrusion 32*a* of the lower arm part 32 is locked to the step part 116*b*.

When the plug housing 10 which has temporarily held the slide member 3 is fitted into the receptacle housing 20, the engagement protrusions 33*b* of the upper arm parts 33 come into contact with the protrusions 211*a* of the top wall 211 and are pressed downward from the initiation to the completion of the fitting. Then, once the plug housing 10 is completely fitted into the receptacle housing 20, the tips of the engagement protrusions 33*b* abut against the lower surfaces of the protrusions 211*a*, so that the upper arm parts 33 are deflected downward. At this time, the protrusions 33*a* of the upper arm parts 33 also move downward to be located at a level lower than the restrictive protrusions (slide restrictors) 111*b* (see FIG. 27).

Thus, once the plug housing 10 is fitted into the receptacle housing 20, the restriction on the forward movement of the protrusions 33*a*, which is effected by the restrictive protrusions 111*b*, is released. This allows the slide member 3 to be slid forward. As described above, in this embodiment, the upper arm parts 33, which are elastically deformable up and down, and the protrusions 33*a*, which are formed on the upper arm parts 33 to be capable of coming into contact with the restrictive protrusions 111*b*, function as the slide lock mechanism.

Figure 28:
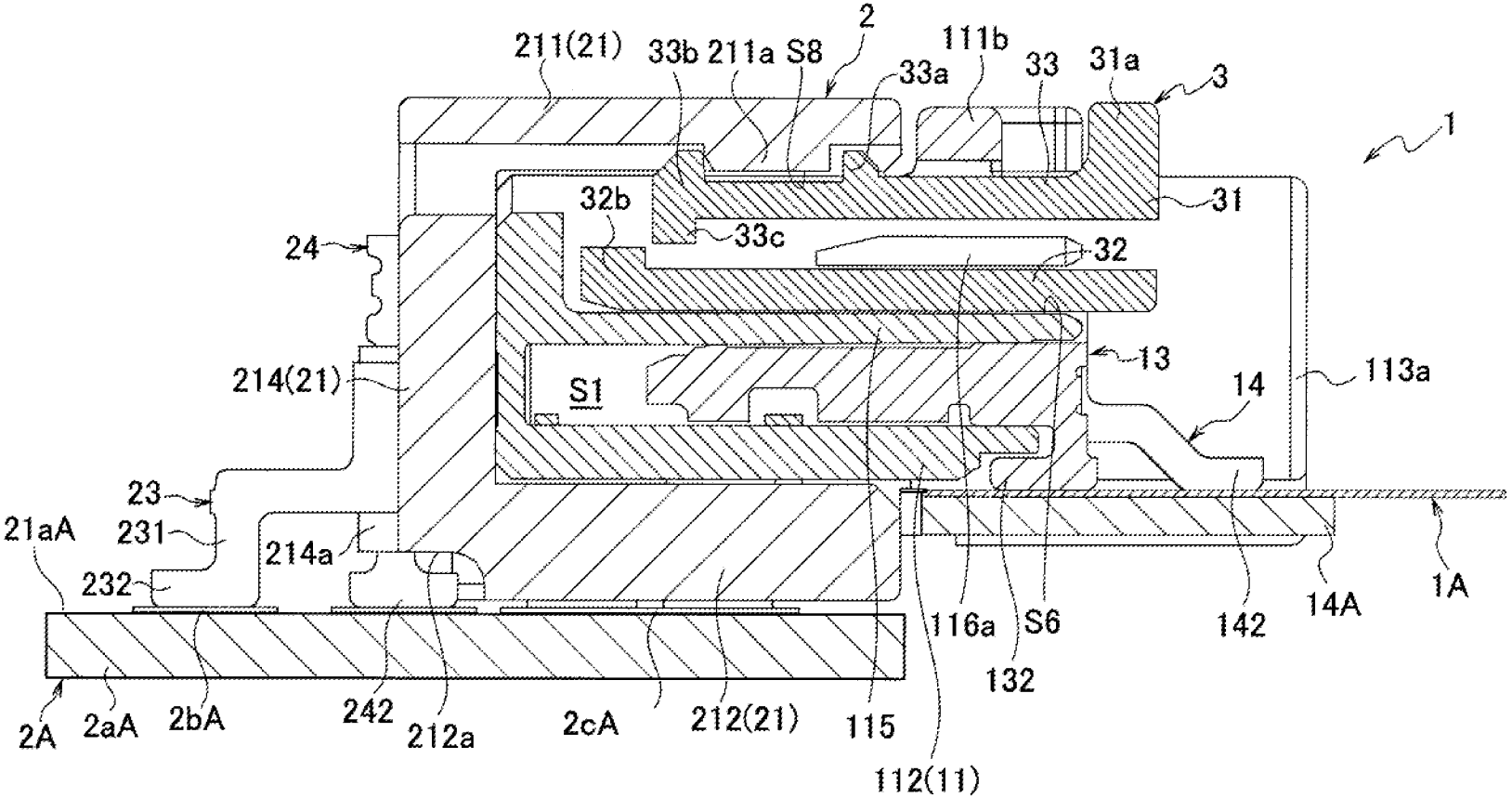
FIG. 28 is a sectional side view explaining how the plug connector and the receptacle connector shown as an example are locked with the slide member and showing a state where the plug connector has been fitted to the receptacle connector and locked with the slide member.

Then, by sliding the slide member 3 forward and locking the engagement protrusions 33*b* of the upper arm parts 33 to the front ends of the protrusions 211*a* of the top wall 211, the plug housing 10 and the receptacle housing 20 are locked in a fitted state with this slide member 3 as well (see FIG. 28). Note that in this embodiment, the slide member 3 is regarded as being at the slide completion position (completion position: second position) when the engagement protrusions 33*b* of the upper arm parts 33 are locked to the front ends of the protrusions 211*a* of the top wall 211.

In this way, the connector set C1 is locked doubly by the lever part 121 and the slide member 3.

Moreover, in this embodiment, when the slide member 3 is slid to the slide completion position (completion position), the restrictive protrusion (restrictor) 31*b* is inserted into the deflection allowance space S7. Then, the restrictive protrusion 31*b* inserted into the deflection allowance space S7 restricts the downward movement of the lever part 121. Here, it is preferable that the amount of upward protrusion of the restrictive protrusion 31*b* be set such that the engagement protrusion 121*b* and the engagement recess part 221*a* remain engaged with each other even when the lever part 121 is in contact with the restrictive protrusion 31*b*. This makes it possible to prevent the locking with the lever part 121 from being released unless the locking with the slide member 3 is released, and to thus maintain the lock state more securely.

Note that to release the fitting of the connector set C1 doubly locked with the lever part 121 and the slide member 3, the slide member 3 in the slide completion position is first slid to the initial position. In this embodiment, strongly pulling the slide member 3 rearward (toward the initial position) releases the locking between the engagement protrusions 33*b* and the protrusions 211*c*. Accordingly, for example, if an operator or the like grips the handle 31*a* and strongly pulls the slide member 3 rearward, the slide member 3 is slid to the initial position.

In this way, sliding the slide member 3 to the initial position releases the restriction on the downward movement of the lever part 121, making it possible to release the lock with the lever part 121.

Then, performing the above-described operation of removing the plug connector 1 from the receptacle connector 2 removes the plug connector 1 from the receptacle connector 2.

Operations and Effects

As has been described above, the plug connector (connector) 1 according to this embodiment includes the plug housing (housing) 10 and the terminals (the lower plug terminals 13 and the upper plug terminals 14) which have the first and second mounting pieces (mounting parts) to be mounted on the cable (connecting member) 1A and are held by the plug housing 10.

The plug housing 10 has the recess part 112*e*, in which the for-connection portion 10A of the cable 1A is housed and held, and the protrusions 112*d*, which protrude higher than the thickness of the for-connection portion 10A and defines the recess part 112*e*. The protrusions 112*d* are located only at peripheral edge portions of the plug housing 10.

This configuration improves the freedom in the shape of the for-connection portion 10A and the freedom in the arrangement of the for-connection portion 10A within the recess part 112*e* because the protrusions 112*d* which limit the shape (outline shape) of the for-connection portion 10A and the position of the for-connection portion 10A within the recess part 112*e* are not in the center of the plug housing 10.

This embodiment, as described above, provides the plug connector (connector) 1 having a higher freedom of connecting the cable (connecting member) 1A to the plug housing (housing) 10.

In this embodiment, the plurality of terminals (the lower plug terminals 13 and the upper plug terminals 14) are held by the plug housing 10 to be lined side-by-side in the width direction (Y direction: one direction).

In the state where the plurality of terminals 13 and 14 are held by the plug housing 10, the distal ends of the mounting parts (the first and second mounting pieces 132 and 142) of the plurality of terminals 13 and 14 protrude from the plug housing 10 on the side where the recess part 112*e* is provided.

The protrusions 112*d* are located not to overlap with the plurality of mounting parts 132 and 142 when the plug housing 10 holding the plurality of terminals 13 and 14 is viewed along the front-rear direction (X direction: the intersecting direction intersecting the one direction).

This configuration allows the distal ends of the first and second mounting pieces 132 and 142 of the plug terminals to be seen both from the front side and from the rear side when the plug housing 10 holding the terminals (the lower plug terminals 13 and the upper plug terminals 14) is viewed along the front-rear direction (X direction: intersecting direction).

In this embodiment, the mounting parts 132 and 142 are formed in thin plate shapes, and the plurality of terminals 13 and 14 are lined side-by-side along the plate thickness direction of the mounting parts 132 and 142.

This configuration prevents the mounting parts 132 and 142 from deforming in the top-bottom direction (the direction intersecting the plate thickness direction). This in turns prevents the mounting parts 132 and 142 from being deformed by curling of the cable 1A in the top-bottom direction even in the case where the mounting parts 132 and 142 are mounted on the cable 1A in a sheet shape flexible in the top-bottom direction.

In this embodiment, the terminals 13 and 14 have the main body parts (the first main body parts 130 and the second main body parts 140) which are inserted into and held by the plug housing 10. The foregoing intersecting direction agrees with the insertion direction of the main body parts 130 and 140 into the plug housing 10.

Since as described above, the intersecting direction, which is the direction in which the protrusions 112*d* do not overlap with the first and second mounting pieces 132 and 142 of the plug terminals 13 and 14, agrees with the insertion direction in which the main body parts 130 and 140 are inserted into the plug housing 10, the mutual distances in the width direction between the mounting parts 132 and 142 of the terminals 13 and 14, viewed from the intersecting direction, can be set largest. In other words, the direction in which the protrusions 112*d* do overlap with the first and second mounting pieces 132 and 142 of the plug terminals 13 and 14 can be set to agree with the direction in which the distal end of each mounting part can be seen more clearly.

In this embodiment, the cable 1A in a sheet shape is the connecting member on which the terminals 13 and 14 held by the plug housing 10 are to be mounted.

This further increases the freedom of connecting the cable 1A to the plug housing (housing) 10.

In this embodiment, the cable 1A includes the connection region 11A and the extension region 12A extending from the connection region 11A. Then, the for-connection portion 10A includes the connection region 11A and the reinforcing plate 14A attached to the connection region 11A to reinforce it.

This configuration makes the connection of the cable 1A to the plug housing (housing) 10 more firm.

In this embodiment, the connector is the plug connector 1 which is fitted into the receptacle connector (opponent connector) 2 in the state where the terminals 13 and 14 are held by the plug housing 10 and where the mounting parts 132 and 142 are mounted on the cable (connecting member) 1A so that the terminals 13 and 14 are electrically connected to the terminals (the opponent terminals: the lower receptacle terminals 23 and the upper receptacle terminals 24) included in the receptacle connector 2.

This configuration provides the plug connector 1 having a higher freedom of connecting the cable (connecting member) 1A to the plug housing (housing) 10.

Meanwhile, in the case where the distal ends of the mounting parts 132 and 142 protrude from the plug housing 10 on the side where the recess part 112*e* is provided in the state where the plurality of terminals 13 and 14 are held by the plug housing 10, as in this embodiment, the amount of protrusion of each of the mounting parts 132 and 142 from the lower end of the plug housing 10 needs to be uniform to make the mounting of the mounting parts 132 and 142 on the cable 1A more reliable.

The amount of protrusion of each of the mounting parts 132 and 142 from the lower end of the plug housing 10 is checked, generally, by capturing the image of the mounting parts 132 and 142 with a camera 42 in a state where light emitted from a light 41 is being projected to the mounting parts 132 and 142 of the terminals 13 and 14 held by the plug housing 10.

Figure 29A:
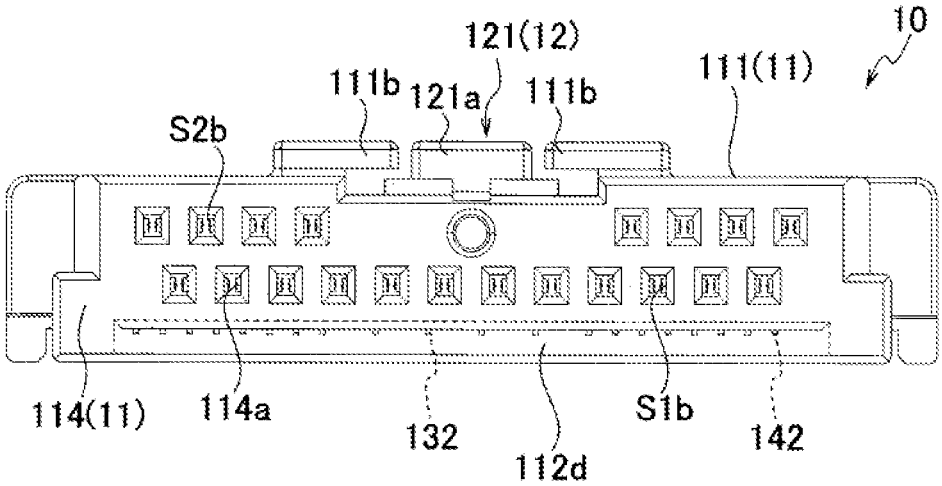
FIGS. 29A and 29B are diagrams for explaining a plug connector shown as a modification.
Figure 29B:
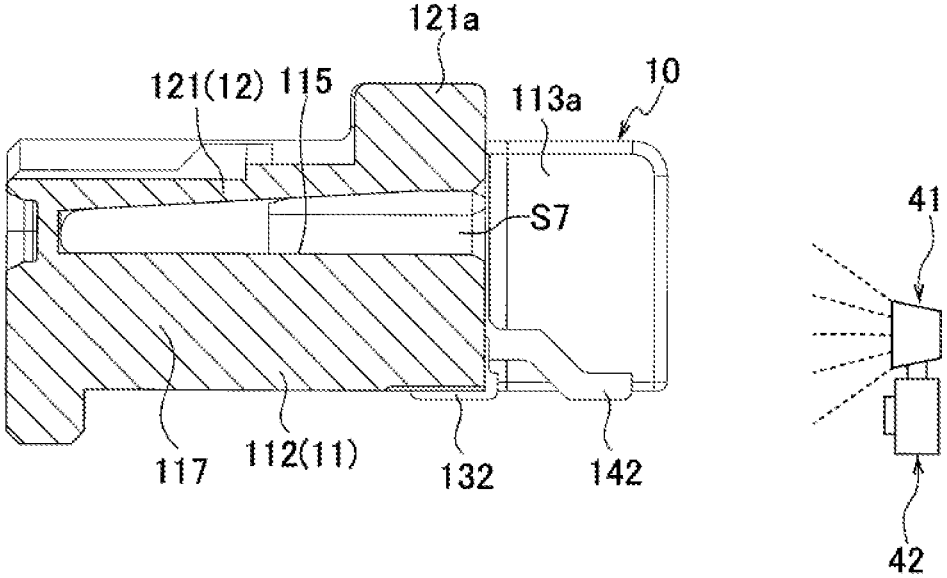

Here, as illustrated in FIGS. 29A and 29B, if the protrusions 12*d* are formed at front portions in the front-rear direction so as to overlap with the mounting parts 132 and 142 in front view, the mounting parts 132 and 142 are hidden behind the protrusions 112*d* when viewed from the front side in the front-rear direction. Thus, to check the amount of protrusion of each of the mounting parts 132 and 142, an image needs to be captured in the state where light is projected to the mounting parts 132 and 142 from the rear side.

In the case where the plate thickness direction of the mounting parts 132 and 142 agrees with the width direction, it is preferable to form a curve at the lower end of each of the mounting parts 132 and 142 to make it easy for a fillet to be formed when the mounting part is mounted by soldering. For this reason, in this embodiment, the lower ends of the mounting parts 132 and 142 are curved.

However, in the case where the lower ends of the mounting parts 132 and 142 are curved, the light projected to the curved portions are diffusely reflected, making the images of the lower ends unclear. For this reason, in the case where an image is captured in the state where light is projected to the mounting parts 132 and 142 from the rear side, the positions of the upper end edges of the mounting parts 132 and 142 are checked, and the amount of protrusion of each of the mounting parts 132 and 142 (the position of the lower end of each of the mounting parts 132 and 142) needs to be estimated using this edge position and the thickness in the top-bottom direction of the mounting parts 132 and 142.

However, in the case where the plate thickness direction of the mounting parts 132 and 142 agrees with the width direction as in this embodiment, the dimensional variation in the top-bottom direction that occurs when the terminals 13 and 14 are formed is large, so that the amount of protrusion of each of the mounting parts 132 and 142 cannot been checked accurately with the above estimation method.

Thus, as above, in the case where the plate thickness direction of the mounting parts 132 and 142 agrees with the width direction and where the lower ends of the mounting parts 132 and 142 are curved for the fillets to be formed easily, the amount of protrusion of each of the mounting parts 132 and 142 cannot be checked accurately by capturing an image with light projected to the mounting parts 132 and 142 from the rear side. Specifically, in the case where the protrusions 112*d* are formed at the front in the front-rear direction as illustrated in FIGS. 29A and 29B and where the terminals 13 and 14 described in this embodiment are used, the amount of protrusion of each of the mounting parts 132 and 142 cannot be checked accurately.

Figure 30A:
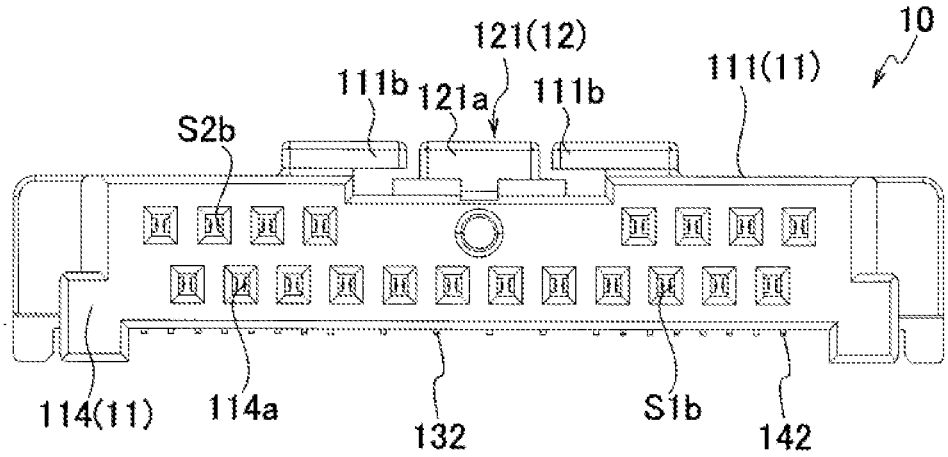
FIGS. 30A and 30B are diagram for explaining a plug connector shown as an example.
Figure 30B:
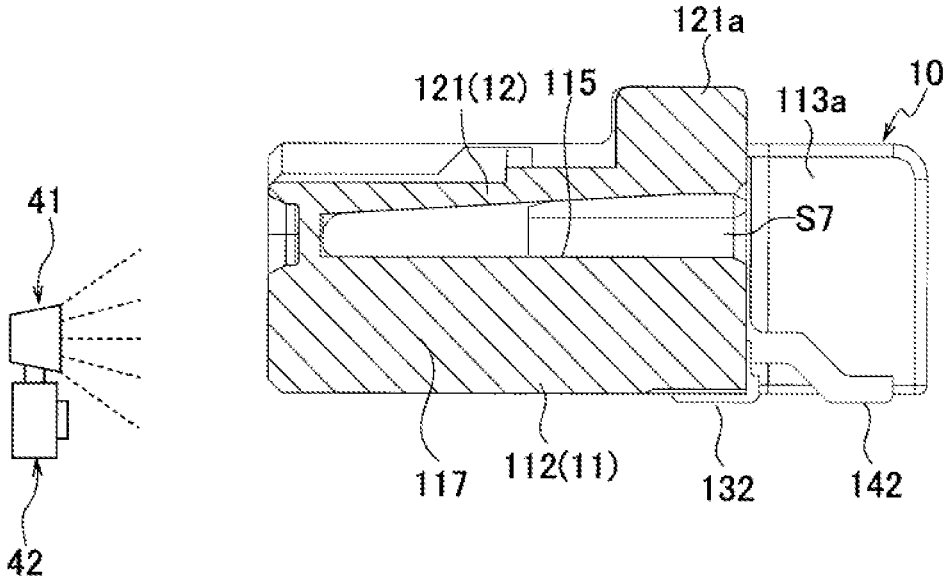

In contrast, as in this embodiment, in the case where the protrusions 112*d* do not overlap with the plurality of mounting parts 132 and 142 when the plug housing 10 holding the plurality of terminals 13 and 14 is viewed along the front-rear direction, an image can be captured in a state where light is projected to the mounting parts 132 and 142 from the front side (see FIGS. 30A and 30B). Then, by capturing an image of the mounting parts 132 and 142 with light projected to them from the front side, the distal end of each of the mounting parts 132 and 142 can be taken more clearly than in the case where light is projected from the rear side.

As described above, with a configuration in which the protrusions 112*d* do not overlap with the plurality of mounting parts 132 and 142 when the plug housing 10 holding the plurality of terminals 13 and 14 is viewed along the front-rear direction, the amount of protrusion of each of the mounting parts 132 and 142 from the lower end of the plug housing 10 can be checked more accurately even in the case of using the terminals 13 and 14 described in this embodiment.

Note that even in the case where the protrusions 112*d* are formed at the front in the front-rear direction so as to overlap with the mounting parts 132 and 142 in front view as illustrated in FIGS. 29A and 29B, if the protrusions 112*d* are formed only at peripheral edge portions of the plug housing 10, it is possible to improve the freedom in the shape of the for-connection portion 10A and the freedom in the arrangement of the for-connection portion 10A within the recess part 112*e*.

Others

Although the preferred embodiment of the present disclosure has been described above, the present disclosure is not limited to the above embodiment and modified examples thereof, but various changes can be made thereto.

For example, although the above-described embodiment and modified example illustrate a connector in which a plurality of terminals are disposed in the upper and lower two stages, it is also possible to make a connector in which a plurality of terminals are disposed only in one stage and a connector in which a plurality of terminals are disposed in three stages or more.

In addition, although the connector in which the terminals disposed in the same stage have the same shape is illustrated, it is also possible to make a connector in which a plurality of types of terminals are disposed in the same stage.

In addition, although in the above embodiment, the terminals in which the plate thickness direction of the mounting parts agrees with the direction in which the terminals are lined side-by-side have been illustrated as an example, it is possible to use terminals in which the plate thickness direction of the mounting parts agrees with the top-bottom direction.

In addition, although in the above embodiment, an example in which the intersecting direction agrees with the front-rear direction (the insertion direction of the main body parts of the terminals) has been illustrated, the intersecting direction only needs to be a direction in which the plurality of terminals can be seen in the state where the mounting parts are apart from one another, and hence the intersecting direction may be a direction intersecting the front-rear direction.

In addition, although in the above embodiment, an example has been illustrated in which the protrusions are not formed in the entire area where the terminals are located when viewed along the intersecting direction, the present disclosure is not limited to this configuration. For example, a configuration may be such that the protrusions are formed to overlap with the terminals when viewed along the intersecting direction, that a through hole is formed in the protrusion, and that the distal end (the part protruding from the housing) of a mounting part is located within the through hole when viewed along the intersecting direction.

In addition, although in the above embodiment, a connector having a slide member has been illustrated as an example, it is possible to use a connector not including a slide member.

In addition, the present disclosure may be applied to connectors (plug connectors and receptacle connectors) that electrically connect boards or cables with each other. Moreover, the present disclosure may be applied to connectors (plug connectors and receptacle connectors) that electrically connect an electric wire with a board and to connectors (plug connectors and receptacle connectors) that electrically connect an electric wire with a cable.

In addition, specifications (shapes, sizes, layouts, and the like) of the housings, the terminals, and the other details may also be changed as needed.

The invention claimed is:

1. An electrical connector comprising:

a housing including;

a top wall and a bottom wall arranged in a first direction, and a pair of side walls arranged in a second direction intersecting with the first direction, each side wall is connecting an end, in the second direction, of the top wall and an end of the bottom wall; and a terminal held by the housing and protruding in a third direction intersecting with the first direction and the second direction from one end side of the housing, the terminal having a mounting part adapted to be mounted on a conductor part of a connecting member outside of the housing, wherein a recess part in which a for-connection portion of the connecting member is adapted to be housed is formed in the housing, wherein the recess part includes;

a bottom surface formed in either one of the top wall and the bottom wall and a protrusion protruding in the first direction with respect to the bottom surface and defining the recess part, and the protrusion is located only at a peripheral edge portion of the housing.

2. The electrical connector according to claim 1, wherein a plurality of the terminals are held by the housing to be lined side-by-side in the second direction, a distal end of the mounting part of each terminal held by the housing protrudes from the housing on a side where the recess part is provided in a state where the terminals are held by the housing, and the protrusion does not overlap with the mounting parts in a state where the housing holding the terminals is viewed along an intersecting direction intersecting the second direction.

3. The electrical connector according to claim 2, wherein the mounting part has a thin plate shape, and the terminals are lined side-by-side in a plate thickness direction of the mounting part.

4. The electrical connector according to claim 2, wherein the terminal is inserted into and held by the housing, and the intersecting direction agrees with a direction in which the terminal inserted into the housing.

5. The electrical connector according to claim 1, further comprising the connecting member, the connecting member is a cable in a sheet shape.

6. The electrical connector according to claim 5, wherein the cable includes a connection region having the conductor part and an extension region extending from the connection region, the for-connection portion includes the connection region and a reinforcing plate attached to the connection region to reinforce the connection region, and wherein the for-connection portion, the recess part and the reinforcing plate are configured such that when the for-connection portion is housed in the recess part, the reinforcing plate is housed in the recess part.

7. The electrical connector according to claim 1, wherein by fitting the connector into an opponent connector in a state where the terminal is held by the housing and where the mounting part is mounted on the connecting member, the terminal is electrically connected to an opponent terminal included in the opponent connector.

8. The electrical connector according to claim 1, wherein the protrusion, the for-connection portion and the recess part are configured such that the protrusion is protruding higher than a thickness of the for-connection portion of the connecting member and defining the recess part, when the for-connection portion of the connecting member is housed in the recess part.

9. The electrical connector according to claim 1, wherein a plurality of the protrusions are defining the recess part.

* * * * *